US011191333B2

(12) United States Patent
Stone et al.

(10) Patent No.: US 11,191,333 B2
(45) Date of Patent: Dec. 7, 2021

(54) INTERCONNECTING LUGGAGE SYSTEM

(71) Applicant: Glide Luggage Pty Ltd, Richmond (AU)

(72) Inventors: Adrian Stone, Richmond (AU); Timothy John Ford, Richmond (AU); Han Young Hwang, Richmond (AU)

(73) Assignee: GLIDE LUGGAGE PTY LTD, Richmond (AU)

( * ) Notice: Subject to any disclaimer, the term of this patent is extended or adjusted under 35 U.S.C. 154(b) by 223 days.

(21) Appl. No.: 16/310,730

(22) PCT Filed: Jun. 12, 2018

(86) PCT No.: PCT/AU2018/050582

§ 371 (c)(1),
(2) Date: Dec. 17, 2018

(87) PCT Pub. No.: WO2018/227243

PCT Pub. Date: Dec. 20, 2018

(65) Prior Publication Data

US 2020/0178661 A1 Jun. 11, 2020

(30) Foreign Application Priority Data

Jun. 13, 2017 (AU) ..... 2017902235

(51) Int. Cl.
*A45C 5/14* (2006.01)
*A45C 7/00* (2006.01)
*A45C 13/26* (2006.01)

(52) U.S. Cl.
CPC ..... *A45C 7/0045* (2013.01); *A45C 5/14* (2013.01); *A45C 13/262* (2013.01); *A45C 2005/148* (2013.01)

(58) Field of Classification Search
CPC ... A45C 7/0045; A45C 2005/148; A45C 5/14; A45C 5/145; A45C 13/262
(Continued)

(56) References Cited

U.S. PATENT DOCUMENTS 5,365,635 A * 11/1994 Jang ..... A45C 5/145 16/34
5,758,752 A 6/1998 King et al.
(Continued)

FOREIGN PATENT DOCUMENTS

WO 2015049121 A1 4/2015

OTHER PUBLICATIONS

International Search Report dated Sep. 3, 2018 for corresponding International Patent Application PCT/AU2018/050582 filed on Jun. 12, 2018.

(Continued)

*Primary Examiner* — Sue A Weaver
(74) *Attorney, Agent, or Firm* — David D. Brush; Westman, Champlin & Koehler, P.A.

(57) ABSTRACT

A system of interconnecting luggage includes first and second luggage items. The first luggage item has a handle about an upper end and rolling elements about a base, and is tiltable about a rotational axis of the rolling elements by the handle. The second luggage item also has rolling elements about a base. Each of the first and second luggage items have integral mutual engagement and disengagement elements configured to provide, when the first and second luggage items are mutually engaged, a substantially rigid mechanical connection that maintains the first and second luggage items in relative spatial arrangement such that when the system is in a stable arrangement, the rolling elements of the first and second luggage items contact an underlying planar substrate, and the first luggage item is maintained at a tilt angle relative to the underlying planar substrate.

17 Claims, 15 Drawing Sheets

(58) Field of Classification Search
USPC ..... 190/108
See application file for complete search history.

(56) References Cited

U.S. PATENT DOCUMENTS

| | | | | |
|---|---|---|---|---|
| 6,533,086 | B1 | 3/2003 | Waddell et al. | |
| 9,033,125 | B2 * | 5/2015 | Herold | A45C 5/14 190/18 A |
| 10,130,150 | B2 * | 11/2018 | Barenbrug | A45C 13/04 |
| 2004/0041360 | A1 * | 3/2004 | Lukoszek | A63C 17/015 280/11.27 |
| 2005/0110231 | A1 * | 5/2005 | Brown | B62B 3/027 280/47.26 |
| 2008/0000742 | A1 | 1/2008 | Lee et al. | |
| 2009/0218187 | A1 * | 9/2009 | Chung | A45C 5/143 190/18 A |
| 2010/0059323 | A1 | 3/2010 | Marji | |
| 2010/0163358 | A1 | 7/2010 | Tsai et al. | |
| 2010/0170761 | A1 | 7/2010 | Herold | |
| 2013/0175129 | A1 * | 7/2013 | Rankin | A45C 5/14 190/18 A |
| 2015/0136553 | A1 | 5/2015 | Den Boer et al. | |

OTHER PUBLICATIONS

Written Opinion dated Sep. 3, 2018 for corresponding International Patent Application PCT/AU2018/050582 filed on Jun. 12, 2018.

* cited by examiner

INTERCONNECTING LUGGAGE SYSTEM

The present application is a Section 371 U.S. National Stage Application of International Application No. PCT/AU2018/050582, filed Jun. 12, 2018, not yet published, which is incorporated by reference in its entirety.

FIELD OF THE INVENTION

The present invention relates generally to the field of luggage used by individual persons in the course of travel. In particular, the invention relates to luggage having rolling means such as wheels, rollers and castors.

BACKGROUND TO THE INVENTION

The can be little doubt that introduction of wheeled luggage has transformed travelling. No longer is it necessary to use a luggage trolley at an airport or other transport base. The wheels which are part of almost all modern hand luggage allow a traveller to move about relatively quickly and easily even with many kilograms stowed.

A more recent advance in luggage is the so-called "spinner" case, which is typically of a polymer shell construction having castors at all four corners of an edge face. An upwardly extendable handle allows a traveller to push, pull or rotate the case as required.

While wheeled luggage is a definite advance in the art, problems nevertheless arise when multiple items of luggage are carried by a traveller. There is some difficulty in pulling or pushing two separate items of wheeled luggage. Each item is independently steerable and a good amount of attention and coordination is required to ensure both times roll in the desired direction.

Further complication arises where the traveller requires a free hand to deal with cell phone call or to control an accompanying child. Often, one item of luggage is sat on top of the upper face of another other luggage item this leaving the traveller with a free hand. However, the upper item may shift (especially during a cornering manoeuvre) leading to the entire connected arrangement tipping over. Stability of the connected arrangement may be improved by the use straps and ties of various types, however the two luggage items must be separated again at a check-in counter for example.

The prior art seeks to overcome such problems with numerous examples of trolleys capable of engaging and carrying multiple items of luggage. Many such trolleys are bulky and heavy adding significantly to a traveller's baggage weight allowance. Other approaches taken by prior artisans rely on binding together multiple items of wheeled luggage using various interlocking means.

These connected arrangements are quite difficult to steer, and are generally restricted to being pulled along.

It is an aspect of the present invention to provide a luggage system which comprises of multiple luggage items that is easily manoeuvred with a single hand, and furthermore allows a traveller to either push or pull as required.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF THE INVENTION

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

Certain advantages of some embodiments of the invention are disclosed herein. It is not represented that all embodiments have all the advantages disclosed. Some embodiments may provide no advantage whatsoever over the prior art, and instead merely represent a useful alternative thereto.

In a first aspect, but not necessarily the broadest aspect, the present invention provides a system of interconnecting luggage, the system comprising: a first luggage item having a handle about an upper end and rolling means about a base, and being tiltable about a rotational axis of the rolling means by the handle, a second luggage item having rolling means about a base, each of the first and second luggage items having integral mutual engagement and disengagement means configured to provide, when the first and second luggage items are mutually engaged, a substantially rigid mechanical connection that maintains the first and second luggage items in relative spatial arrangement such that when the system is in a stable arrangement the rolling means of the first and second luggage item contact an underlying planar substrate, the first luggage item is maintained at a tilt angle relative to the underlying planar substrate.

In one embodiment of the first aspect, the first luggage item has a long axis, and the long axis of the first luggage item is tilted when the system is in a stable arrangement whereby the rolling means of the first and second luggage item contact an underlying planar substrate, the tilt being in a direction such that the long axis of the first luggage item forms an acute angle with the underlying planar substrate.

In one embodiment of the first aspect, the tilt angle of the first luggage item is maintained by way of the mutual engagement and disengagement means in combination with the support of the second luggage item.

In one embodiment of the first aspect, when the first and second luggage items are mutually engaged and the system is in a stable arrangement whereby the rolling means of the first and second luggage item contact an underlying planar substrate, the tilt angle of the first luggage item is greater than about 0.1 degrees, or is greater than about 0.5 degrees, or is greater than about 1 degrees, or is greater than about 2 degrees, or is greater than about 3 degrees, or is greater than about 4 degrees, is greater than about 5 degrees, or is greater than about 6 degrees, or is greater than about 7 degrees, or is greater than about 8 degrees, or is greater than about 9 degrees, or is greater than about 10 degrees, or is greater than about 10 degrees, or is greater than about 11 degrees, or is greater than about 12 degrees, or is greater than about 13 degrees, or is greater than about 14 degrees, or is greater than about 15 degrees, or is greater than about 16 degrees, or is greater than about 17 degrees, or is greater than about 18 degrees, or is greater than about 19 degrees, or is greater than about 20 degrees, or is greater than about 21 degrees, or is greater than about 22 degrees, or is greater than about 23 degrees, or is greater than about 24 degrees, or is greater than about 25 degrees, or is greater than about 26 degrees, or is greater than about 27 degrees, or is greater than about 28 degrees, or is greater than about 29 degrees, or is greater than about 30 degrees, the tilt angle being taken with reference to (i) a line orthogonal to a planar substrate on which the system is disposed, or (ii) the vertical.

In one embodiment of the first aspect, when the first and second luggage items are mutually engaged and the system is in a stable arrangement whereby the rolling means of the first and second luggage item contact an underlying planar substrate, the tilt angle of the first luggage item is less than about 0.1 degrees, or is less than about 0.5 degrees, or is less than about 1 degrees, or is less than about 2 degrees, or is less than about 3 degrees, or is less than about 4 degrees, or is less than about 5 degrees, or is less than about 6 degrees, or is less than about 7 degrees, or is less than about 8 degrees, or is less than about 9 degrees, or is less than about 10 degrees, or is less than about 10 degrees, or is less than about 11 degrees, or is less than about 12 degrees, or is less than about 13 degrees, or is less than about 14 degrees, or is less than about 15 degrees, the tilt angle being taken with reference to (i) a line orthogonal to a planar substrate on which the system is disposed, or (ii) the vertical.

In one embodiment of the first aspect, when the first and second luggage items are mutually engaged and the system is in a stable arrangement whereby the rolling means of the first and second luggage item contact an underlying planar substrate, the tilt angle of the second luggage item is greater than about 0.1 degrees, or is greater than about 0.5 degrees, or is greater than about 1 degrees, or is greater than about 2 degrees, or is greater than about 3 degrees, or is greater than about 4 degrees, is greater than about 5 degrees, or is greater than about 6 degrees, or is greater than about 7 degrees, or is greater than about 8 degrees, or is greater than about 9 degrees, or is greater than about 10 degrees, or is greater than about 10 degrees, or is greater than about 11 degrees, or is greater than about 12 degrees, or is greater than about 13 degrees, or is greater than about 14 degrees, or is greater than about 15 degrees, the tilt angle being taken with reference to (i) a line orthogonal to a planar substrate on which the system is disposed, or (ii) the vertical.

In one embodiment of the first aspect, when the first and second luggage items are mutually engaged and the system is in a stable arrangement whereby the rolling means of the first and second luggage item contact an underlying planar substrate, the tilt angle of the second luggage item is less than about 0.1 degrees, or is less than about 0.5 degrees, or is less than about 1 degrees, or is less than about 2 degrees, or is less than about 3 degrees, or is less than about 4 degrees, or is less than about 5 degrees, or is less than about 6 degrees, or is less than about 7 degrees, or is less than about 8 degrees, or is less than about 9 degrees, or is less than about 10 degrees, or is less than about 10 degrees, or is less than about 11 degrees, or is less than about 12 degrees, or is less than about 13 degrees, or is less than about 14 degrees, or is less than about 15 degrees, or is less than about 16 degrees, or is less than about 17 degrees, or is less than about 18 degrees, or is less than about 19 degrees, or is less than about 20 degrees, or is less than about 21 degrees, or is less than about 22 degrees, or is less than about 23 degrees, or is less than about 24 degrees, or is less than about 25 degrees, or is less than about 26 degrees, or is less than about 27 degrees, or is less than about 28 degrees, or is less than about 29 degrees, or is less than about 30 degrees, the tilt angle being taken with reference to (i) a line orthogonal to a planar substrate on which the system is disposed, or (ii) the vertical.

In one embodiment of the first aspect, the second luggage item has rolling means proximal to the first luggage item and optionally rolling means distal to the first luggage item such that when the first and second luggage items are mutually engaged and the system is in a stable arrangement the rolling means of the first and second luggage item contact an underlying planar substrate, the rolling means of the second luggage item that is proximal to the first luggage item contacts the underlying planar substrate, and the rolling means of the second luggage item that is distal to the first luggage item (where present) does not contact the underlying substrate.

In one embodiment of the first aspect, the tilt angle and tilt direction of the second luggage angle item is substantially the same as that for the first luggage item.

In one embodiment of the first aspect, first luggage item comprises rolling means distal to the second luggage item, and the first luggage item is devoid of rolling means proximal to the second luggage item.

In one embodiment of the first aspect, the second luggage item comprises rolling means distal to the first luggage item and rolling means proximal to the first luggage item.

In one embodiment of the first aspect, one, some or all of the rolling means of the first luggage item has a fixed rotational axis.

In one embodiment of the first aspect, one, some, or all of the rolling means of the first luggage item is a fixed wheel, or fixed laterally arranged pair of wheels, or a fixed roller, or a fixed laterally arranged paired rollers.

In one embodiment of the first aspect, one, some or all of the rolling means of the second luggage item has a swivel axis.

In one embodiment of the first aspect, the rolling means of the second luggage item having a swivel axis is a castor or a laterally arranged pair of castors, or a swivelling wheel, or a laterally arranged pair of swivelling wheels.

In one embodiment of the first aspect, the rolling means of the second luggage item having a swivel axis is proximal to the first luggage item.

In one embodiment of the first aspect, the second luggage item and/or the rolling means of the second luggage item is/are configured such that that the angle of the swivel axis relative to an axis of the second luggage item and/or relative to an axis of the first luggage item is adjusted or adjustable.

In one embodiment of the first aspect, the second luggage item and/or the rolling means of the second luggage item is/are configured such that that the angle of the swivel axis relative to an axis of the second luggage item and/or relative to an axis of the first luggage item is reversibly lockable.

In one embodiment of the first aspect, the angle of the swivel axis is adjustable such that when the first luggage item is tilted at an angle, the second luggage item is tilted at the same angle, the swivel axis is substantially vertical.

In one embodiment of the first aspect, the second luggage item is configured such that the swivel axis is adjusted or adjustable when a substantially rigid mechanical connection is formed between the first and second luggage items by way of the integral mutual engagement and disengagement means.

In one embodiment of the first aspect, the first and second luggage items are mutually engaged and the system is in a stable arrangement whereby the rolling means of the first and second luggage item contact an underlying planar substrate, only a single rolling means of the first luggage item contacts the underlying planar substrate, and only a single rolling means of the second luggage item contacts the underlying planar substrate.

In one embodiment of the first aspect, when the first and second luggage items are mutually engaged and the system is in a stable arrangement whereby the rolling means of the first and second luggage item contact an underlying planar substrate, only a single laterally arranged pair of rolling means of the first luggage item contacts the underlying planar substrate, and only a single laterally arranged pair of rolling means of the second luggage item contacts the underlying planar substrate.

In one embodiment of the first aspect, when the first and second luggage items are mutually engaged and the system is in a stable arrangement whereby the rolling means of the first and second luggage item contact an underlying planar substrate, only two or four rolling means in total are in contact with the underlying substrate.

In one embodiment of the first aspect, the system is configured to allow the system to be tilted by a force manually applied to the handle of the first luggage item, the tilt angle being sufficient so as to move the system from a stable arrangement whereby the rolling means of the first and second luggage item contact an underlying planar substrate, to an unstable arrangement whereby no rolling means of the second luggage item contacts the underlying substrate.

In one embodiment of the first aspect, each of the luggage items has sufficiently rigidity so as to maintain any tilt angle in any luggage item whether the system is in a stable arrangement whereby the rolling means of the first and second luggage item contact an underlying planar substrate, or an unstable arrangement whereby no rolling means of the second luggage item contacts the underlying substrate.

In one embodiment of the first aspect, the mutual engagement and disengagement means is configured so as to inhibit or prevent inadvertent movement of the first and second luggage items relative to each other, but to facilitate separation of the first and second luggage items for independent use.

In one embodiment of the first aspect, the mutual engagement and disengagement means allows for the sliding engagement and sliding disengagement.

In one embodiment of the first aspect, the mutual engagement and disengagement means comprises mutually engaging and disengaging male and female parts.

In a second aspect, the present invention provides a luggage item configured to be operable as a first luggage item according to any embodiment of the system of the first aspect.

In one embodiment of the second aspect, the luggage item comprises one part of a substantially rigid mutual engagement and disengagement means.

In one embodiment of the second aspect, the luggage item is configured such that the substantially rigid mutual engagement and disengagement means is maintained in fixed spatial relationship to a rolling means of the luggage item.

In a third aspect, the present invention provides a luggage item configured to be operable as a second luggage item according to the system of any embodiment of the first aspect.

In one embodiment of the third aspect, the luggage item comprises one part of a substantially rigid mutual engagement and disengagement means.

In one embodiment of the third aspect, the luggage item is configured such that the substantially rigid mutual engagement and disengagement means is maintained in fixed spatial relationship to a rolling means of the luggage item.

In one embodiment of the third aspect, the luggage item comprises rolling means having a swivel axis, wherein the luggage item and/or the rolling means having a swivel axis is/are configured such that such that that the angle of the swivel axis relative to an axis of the luggage item is adjusted or adjustable.

In one embodiment of the third aspect, the luggage item and/or the rolling means is/are configured such that that the angle of the swivel axis relative to an axis of the luggage item is reversibly lockable.

In one embodiment of the third aspect, the angle of the swivel axis is adjustable such that when the luggage item is tilted at an angle, the swivel axis is substantially vertical.

In one embodiment of the third aspect, the luggage item comprises engagement and disengagement means configured to provide a substantially rigid mechanical connection with another luggage item, wherein the luggage item is configured such that the swivel axis is adjusted or adjustable when a substantially rigid mechanical connection is formed between the luggage item and another. In a fourth aspect, the present invention provides a method for providing a rollable luggage arrangement, the method comprising the steps of engaging the luggage item of any embodiment of the second aspect with the luggage item of any embodiment of the first aspect such that either or both of the luggage items is/are maintained at a tilt angle.

In a fifth aspect, the present invention provides a method for providing two separate luggage items, the method comprising the steps of providing the system of any embodiment of the first aspect, and disengaging the first luggage item from the second luggage item.

In a sixth aspect, the present invention provides a kit of parts comprising the luggage item of any embodiment of the second aspect, and the luggage item of any embodiment of the third aspect, optionally in combination with instructions defining the methods of any embodiment of the fourth aspect or any embodiment of the fifth aspect.

In a seventh aspect, the present invention provides the luggage item of any embodiment of the second aspect, or the luggage item of any embodiment of the third aspect in combination with instructions defining the method of any embodiment of the fourth aspect or any embodiment of the fifth aspect.

In an eighth aspect, the present invention provides a luggage item having a handle about an upper end and first rolling means about a base, and being tiltable about a rotational axis of the rolling means by the handle, the luggage item configured to be maintained at a tilt angle.

In one embodiment of the eighth aspect, the luggage item comprises second rolling means about the base, wherein the second rolling means is configured so as to maintain the tilt angle.

In one embodiment of the eighth aspect, the second rolling means is adjustable so as to alternatively (i) provide the tilt angle or (ii) provide no tilt angle.

In one embodiment of the eighth aspect, the first rolling means is a pair of coaxially mounted wheels, and the second rolling means is paired castors.

In one embodiment of the eighth aspect, the luggage item comprises a container portion and a support portion, the support portion comprising first and second rolling means, the support portion being connected to the container portion such that the container portion is maintainable at a tilt angle to an underlying substantially planar substrate.

In one embodiment of the eighth aspect, the container portion is hingedly connected by hinge means to the support portion.

In one embodiment of the eighth aspect, the tilt angle is maintained by a biasing means bearing at one end on the support and at the other end on the container means.

In one embodiment of the eighth aspect, the luggage item comprises mounting means configured to allow mounting of a second luggage item thereon.

In a ninth aspect, the present invention provides a system of interconnecting luggage comprising the luggage item of any embodiment of the eighth aspect as a first luggage item, and a second luggage item mounted thereon.

In one embodiment of the ninth aspect, the second luggage item comprises mounting means configured to engage with the mounting means of the first luggage item.

In one embodiment of the eighth aspect, the second luggage item is devoid of rolling means.

In a tenth aspect, the present invention provides a luggage item configured to be operable as a first luggage item according to any embodiment of the system of the ninth aspect.

In an eleventh aspect, the present invention provides a luggage item configured to be operable as a second luggage item according to any embodiment of the system of the ninth aspect.

In a twelfth aspect, the present invention provides a method for providing a rollable luggage arrangement, the method comprising the steps of engaging the luggage item of any embodiment of eighth aspect or the tenth aspect, with the luggage item of any embodiment of the eleventh aspect such that either or both of the luggage items is/are maintained at a tilt angle.

BRIEF DESCRIPTION OF THE DRAWINGS

FIG. 19 is illustrative of, in lateral transparent view, the combination of a castor wheel and wheel tilting mechanism present in the luggage item of FIG. 17 showing the action of the cables on the wheel tilting mechanism.

DETAILED DESCRIPTION OF THE PREFERRED AND NON-LIMITING EMBODIMENTS OF THE INVENTION

Figure 1:
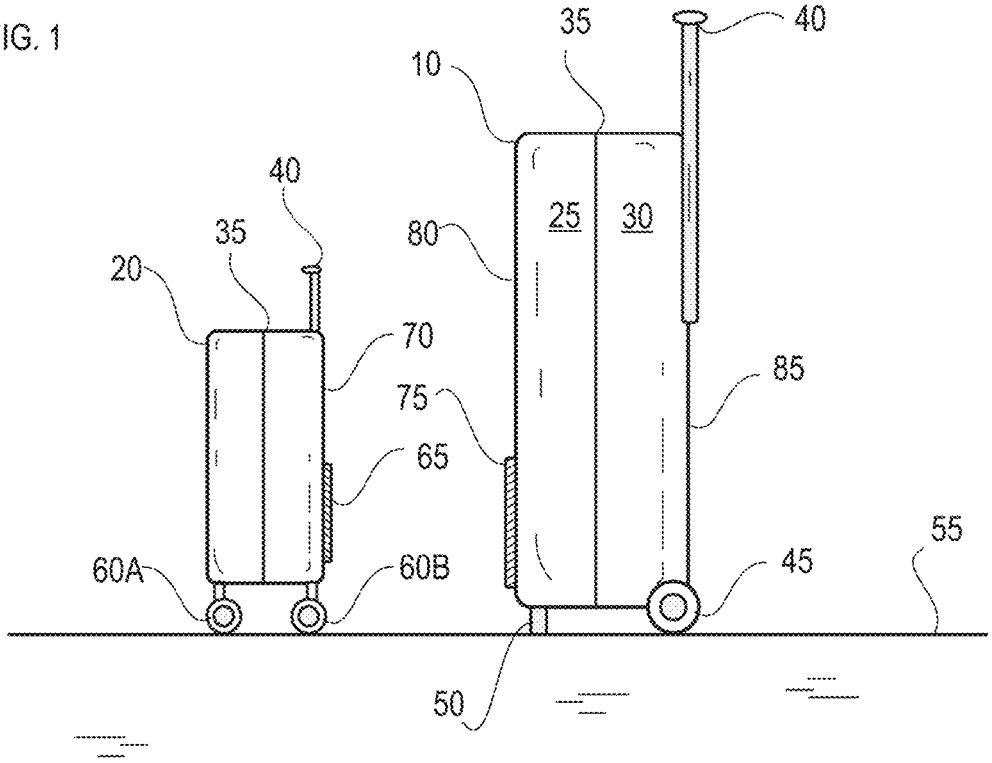
FIG. 1 is illustrative of, in side-on view, two luggage items before connection so as to form the system of the present invention.

Reference is made to FIG. 1 of the drawings which shows two separated luggage items configured for use in accordance with the present system, but nevertheless still entirely useable when separated. The system comprises a first larger luggage item 10, and a second smaller luggage item 15. The larger luggage item 10 is typical of the type that would be checked into the hold of an aircraft or passenger ship, with the smaller item 20 is more likely to be carried on board by the traveller as hand luggage. As will become clear by further reference to this description, the relative sizes of two luggage items 10 and 20 forming the system are immaterial for the purposes of the invention and no limitation as to the relative sizes of the items should be imported.

Turning firstly to the larger luggage item 10, this item is composed mainly of two opposing shells 25, 30 of moulded form which are hinged along one side (not shown), the two shells 25, 30 contacting about their edges along the interface line 35. At the interface 35, there may be fitted an encircling zipper (not shown) which is operable to alternately open and close the luggage item 35. Alternatively, there may be no zipper and instead one or more mechanical catches act to maintain the shells 25, 30 in contact. Also provided is a rigid handle 40 moveable upwardly (to assume a hand-engageable position, as drawn) and downwardly (to assume a substantially concealed position).

The large luggage item 10 further comprises two wheels (one shown and marked as 45, other wheel being directly behind that shown in the drawing). The wheels 45 are rotatable along a single axis which extends orthogonally to the plane of the drawing. A small rest 50 extends downwardly from the luggage item base, acting to stabilise the luggage item when in a vertical (i.e. non-tilted) position. As will be appreciated, the larger luggage item 10 is able to be tilted by the user standing proximal and to the right (as drawn) of the handle 40, and pulling the handle 40 downwardly an in an arc toward the substrate 55. The large luggage item 10 rotates about the rotational axis of the wheels 40, thereby lifting the rest 50 from the substrate so as to allow the luggage item to be rolled forward and back (left to right, as drawn). This particular configuration of the large luggage item 20 is not essential to the invention, and no limitation should therefore be imported.

The smaller luggage item 20 is configured similarly to the large item 10, with analogous components being marked identically. One difference, however, is the presence of four castor wheels (two shown marked 60A and 60B, each of which has a paired castor wheel being directly behind those shown in the drawing). The small luggage item 20 it therefore rollable without tilting, and can spin about its own longitudinal axis. This particular configuration of the small luggage item 20 is not essential to the invention, and no limitation should therefore be imported. In any event, the small item of luggage is entirely usable on its own to hold and transport goods.

The luggage items 10, 20 are mutually engageable and disengageable such that small luggage item 10 is mountable on and dismountable off the large luggage item 20. The mounting is achieved by way of engagement means comprising (i) on the small luggage item 20 a male engagement portion 65 attached to the rear face 70, and (ii) a female engagement portion 75 attached to the front face 80. The operation of the engagement means is discussed more fully infra.

Figure 2:
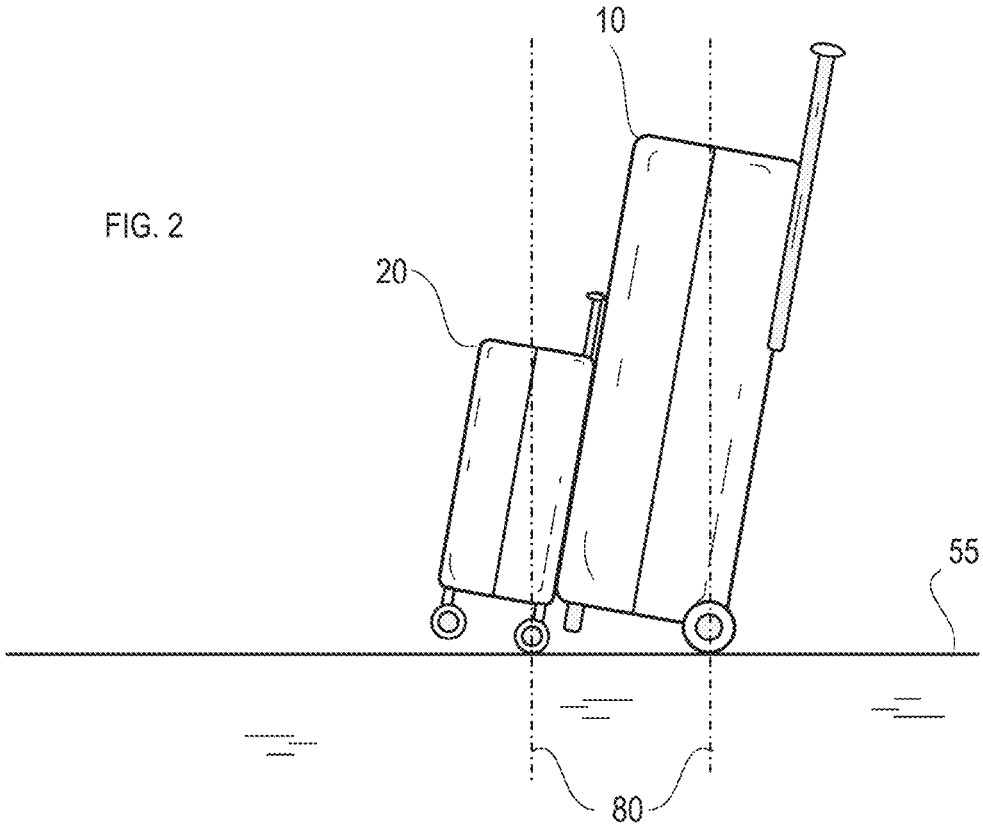
FIG. 2 is illustrative of, in side-on view, the two luggage items of FIG. 1 but connected together so as to form a system of the present invention.
Figure 3A:
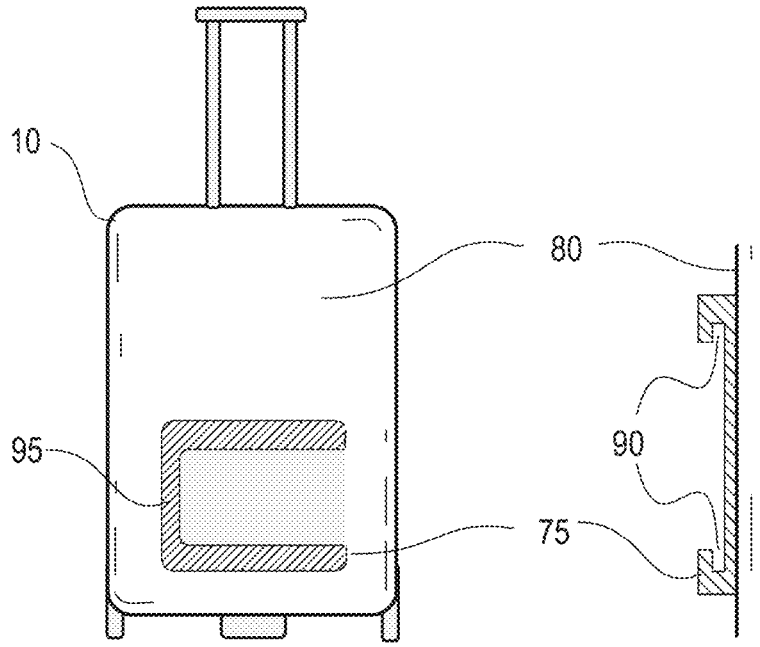
FIG. 3A is illustrative of, in face-on view, a female mutual engagement and disengagement means as applied to the larger item of luggage of FIG. 1.
Figure 3B:
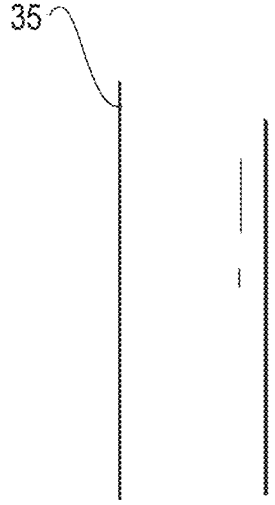
FIG. 3B is illustrative of, in side-on view, the female mutual engagement and disengagement means of FIG. 3A.
Figure 4A:
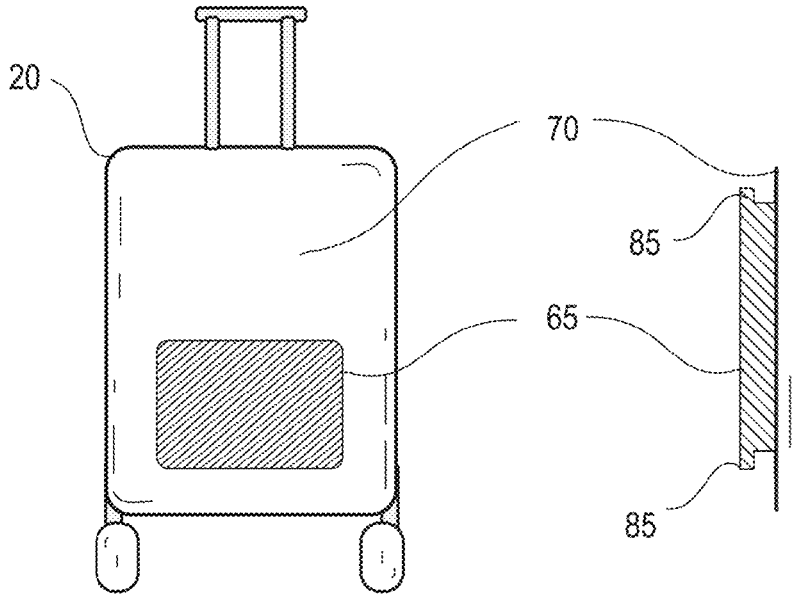
FIG. 4A is illustrative of, in face-on view, a male mutual engagement and disengagement means as applied to the smaller item of luggage of FIG. 1.
Figure 4B:
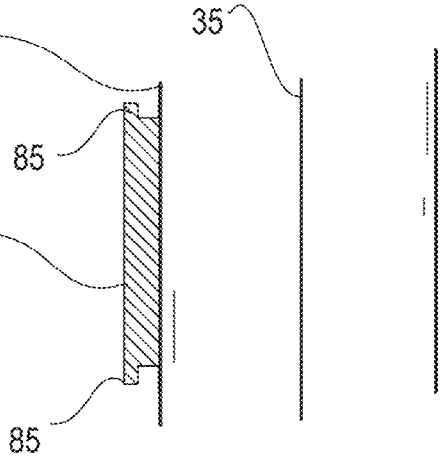
FIG. 4B is illustrative of, in side-on view, the male mutual engagement and disengagement means of FIG. 4A.

Irrespective of the operation of the mutual engagement and disengagement means 65, 75 the mounting of the small luggage item 20 on the large luggage item 10 results in the connected arrangement shown in FIG. 2. In this connected arrangement, both luggage items 10, 20 are tilted (to the right, as drawn) at an angle of 10 degrees to the vertical 85. The connected arrangement is stable to the extent that luggage items 10 and 20 are immovable relative to each other, and paired castors 60B and paired wheels 40 contacting the substrate 55. The connected arrangement can be left unsupported by the user and will not topple. It will be noted that the gravitational centre of the connected arrangement lies between the vertical axes 80 such that the connected arrangement is not liable to tip either to the left or to the right (as drawn).

The connected arrangement is however movable to the extent that it is rollable along the substrate 55, by virtue of the fact that the rest 50 is not in contact with the substrate 55 due to tilting of the large luggage item 10.

It is important to note in the stable connected arrangement shown in FIG. 2 the mutually engaged luggage items 10, 20 are rollable as a single unit by virtue of the paired castors 60B adjacent the rear face 70 of the small luggage item 20, and the wheels 40 adjacent the rear face 85 of the large luggage item 10. The paired castors 60A are lifted from the substrate, and this reduction in the number of rolling means contacting the substrate greatly facilitates handling of the connected arrangement. This reduction in the number of rolling means by way of the tilting provides significant advantages in the handling of luggage when the two items 10 and 20 are connected, and also provides all the advantages of the individual items 10 and 20 when unconnected.

Figure 6:
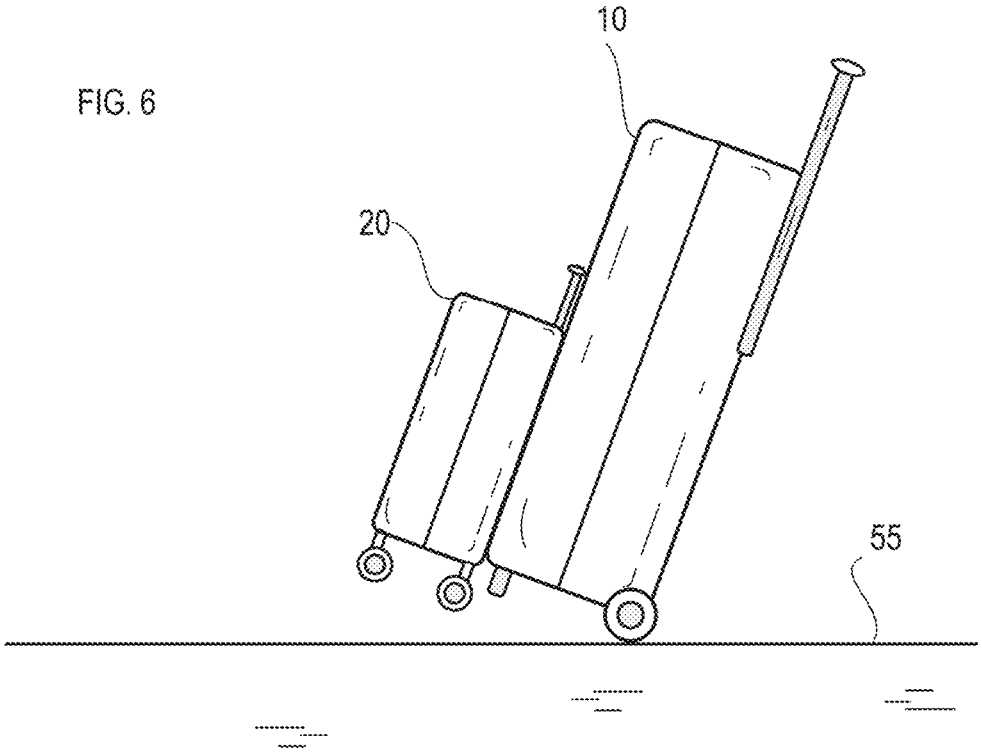
FIG. 6 is illustrative of, in side-on view, the embodiment of FIG. 2 when tilted to an unstable position and usable by pulling to the right (as drawn).

When in the stable connected arrangement shown in FIG. 2, the use of only front rolling means (the paired castors 60B) and rear rolling means (the co-axial wheels 40) means that the connected arrangement functions in much the same manner as a luggage trolley of the type often found at airports. The rear wheels 40 are essentially fixed in terms of directionality and tends to move the connected arrangement in a straight line, while the castors 60B afford some ability to change direction by allowing for lateral swinging of the front end of the connected arrangement left or right. Moreover, a simple manual tilting of the apparatus (as shown in FIG. 6) allows for the front end of the connected arrangement to be lifted (the paired castors 60B also lifting from the substrate 55) thereby permitting rotation of the large luggage item 10 about its longitudinal axis and instantaneous change in direction.

Where both pairs of castors 60A and 60B are allowed to remain in contact with the substrate, the manoeuvrability of the connected arrangement is substantially compromised.

A required tilt angle may be effected by altering any one or more of: the position (and particularly the height) of the female engagement portion on the face 80, the position (and particularly the height) of the male engagement portion on the face 70, the vertical distance between the bottom of the castor 60B and the male engaging portion 65, and the vertical distance between the bottom of the wheel 45 and the female engaging portion 75. The tilt angle may be arrived at by optimization studies being within the ability of the skilled artisan having the benefit of the present specification, and seeking to provide for improved stability of the connected arrangement (when rolling or stationary) and improved rolling or manoeuvrability.

Turning now to a more full consideration of the mutual engagement and disengagement means, it will be understood that the engagement means 65, 75 must be sufficiently rigid so as to prevent any relative movement of the two luggage items 10, 20. If appreciable relative movement was allowed, the large luggage item 10 would tend to settle (under the force of gravity) to a level (non-tilted) position so as to be vertical again. The relative movement would also allow the small luggage item 20 to return to the vertical. Where both luggage items 10, 20 return to the vertical, the rest 50 and the front paired castors 60A again contact the substrate which results in the connected arrangement being no longer rollable. Even if the large luggage item 10 had paired rolling means in place of the rest 50, the connected arrangement would rollable however would have poor manoeuvrability given that no less than eight rolling means would be in contact with the substrate 55.

A simple mutual and disengagement means operable in the context of the present invention is shown in FIGS. 3, 3A, 4A and 4B. The large luggage item 10 has fixed to its face 80 a female engagement portion 75. The small luggage item 10 has fixed to its face 80 a male engagement portion 65. As will be most clearly seen in the lateral views of FIGS. 3B and 4B the male engagement portion 65 has lugs 85 which slide into recesses 90 of the female engagement portion 75. Both male 65 and female 75 engagement portions are precision fabricated from a high density polymer so as to provide for minimal play between the portions 65 and 75 when mutually engaged and also minimal deformation of the mutual engagement means as a whole.

To mount the small luggage item 20 on the large luggage item 10, the large luggage item 20 may be laid down on a substrate such that the face 80 is directed upwardly. The small luggage item 20 is held and oriented by the user such that the face 70 is directed downwardly. The small luggage item 20 is then moved laterally toward the large luggage item 10 such that the lugs 85 of the male engagement portion 65 sliding engage with the recesses 90 of the female engagement portion 75 until stopped by the closed end 95 of the female engagement portion 75. By this mutual engagement, during rolling the male engagement portion 65 (and therefore the small luggage item) is unable to move to the left (as drawn), or upwardly (as drawn) or downwardly (as drawn).

The male engagement portion is nevertheless able to move to the right (as drawn), for example when cornering, and so some means for preventing right lateral movement may be incorporated. One means of preventing such movement may be a reversible locking means which is configured to assume an unlocked position which allows for the small luggage item 20 to be mounted and dismounted, and alternatively a locked configuration which prevents lateral movement of the small luggage item 20 when mounted on the large luggage item 10. One suitable locking means is a spring loaded pin (not shown) which when in the locked configuration the pin is biased so as to extend laterally (as drawn) into one of the recesses 90 and through into one of the lugs 85 resident therein so as to secure the recess 90 to the lug 85, and which when in the unlocked configuration the pin is withdrawn against the bias by the user such that the pin is withdrawn from the lug 85 so as to allow lateral movement of the lug 85 through the recess 90. As will be appreciated, the spring loaded pin must be actable by the user when the luggage items 10, 20 are fully connected and in which case user access to the engagement portions 65 and 75 is limited or prevented. A lever means which extends outwardly at one end (so as to be accessible by a user) and inwardly (so as to actuate the spring loaded pin) may be implemented.

As mentioned supra, the tilt angle of the large luggage item 10 (at least) is maintained when the connected arrangement is a stable and the rolling means of the first and second luggage item contact an underlying planar substrate. Maintenance of the tilt angle is dependent not only on the rigidity of the engagement means, but also the portions of the luggage items from which the engagement means extend. The tilt angle will not be maintained where the engagement means is rigid, but the engagement means is fixed to or otherwise extends from a flexible portion of the main luggage item structure. The materials from which existing hard shell luggage is constructed provide sufficient rigidity in that regard. As will be appreciated, the walls of existing hard shell luggage is deformable to a limited extent, and may be pushed inwardly upon the application of finger force only in a direction orthogonal to the plane of the wall. However, the wall is substantially incapable of movement in a direction lateral to the plane of the wall and will not for example, buckle or fold or bend. Some of this resistance to lateral deformation may arise from the overall construction of the luggage item and is not necessarily dependant purely on the material of fabrication.

It will be appreciated that materials used in soft luggage items such as canvas and heavy duty synthetic fabrics are susceptible to bending, buckling or folding and will therefore not have the rigidity required to maintain the large luggage item 10 at a tilt angle. Such materials will result in an overall slumping of the connected arrangement. Moreover, the use of deformable materials will not allow for the second luggage item 10 to be maintained at the same tilt angle as the first luggage item 20, as is generally preferred. The effect of any slumping or discordance between tilt angles of the large 20 and small 10 luggage items is to disrupt the preferred arrangement whereby only the castors 60B and wheels 45 are in contact with the substrate.

It will be understood however, that there is not require for either or both of the small 20 and/or large 10 luggage item to be fabricated completely from rigid materials. For example, the small luggage item 20 may be fabricated mainly from a heavy duty cloth (much like a duffle bag), although having with a rigid L-shaped brace which mechanically connects the male engagement portion 65 to the paired castors 60A and 60B. Referring to small luggage item 20 of FIG. 1, the L-shaped brace would sit at the lower right hand corner of the item 20, with the vertical portion of the brace acting as a mounting point for the male engagement portion 65, and the horizontal portion of the brace acting as a mounting point for the castors 60A and 60B. A similar L-shaped brace arrangement could be applied so as to provide a mounting point for the female engagement portion 75, the rest 50 and wheels 45.

Figure 5:
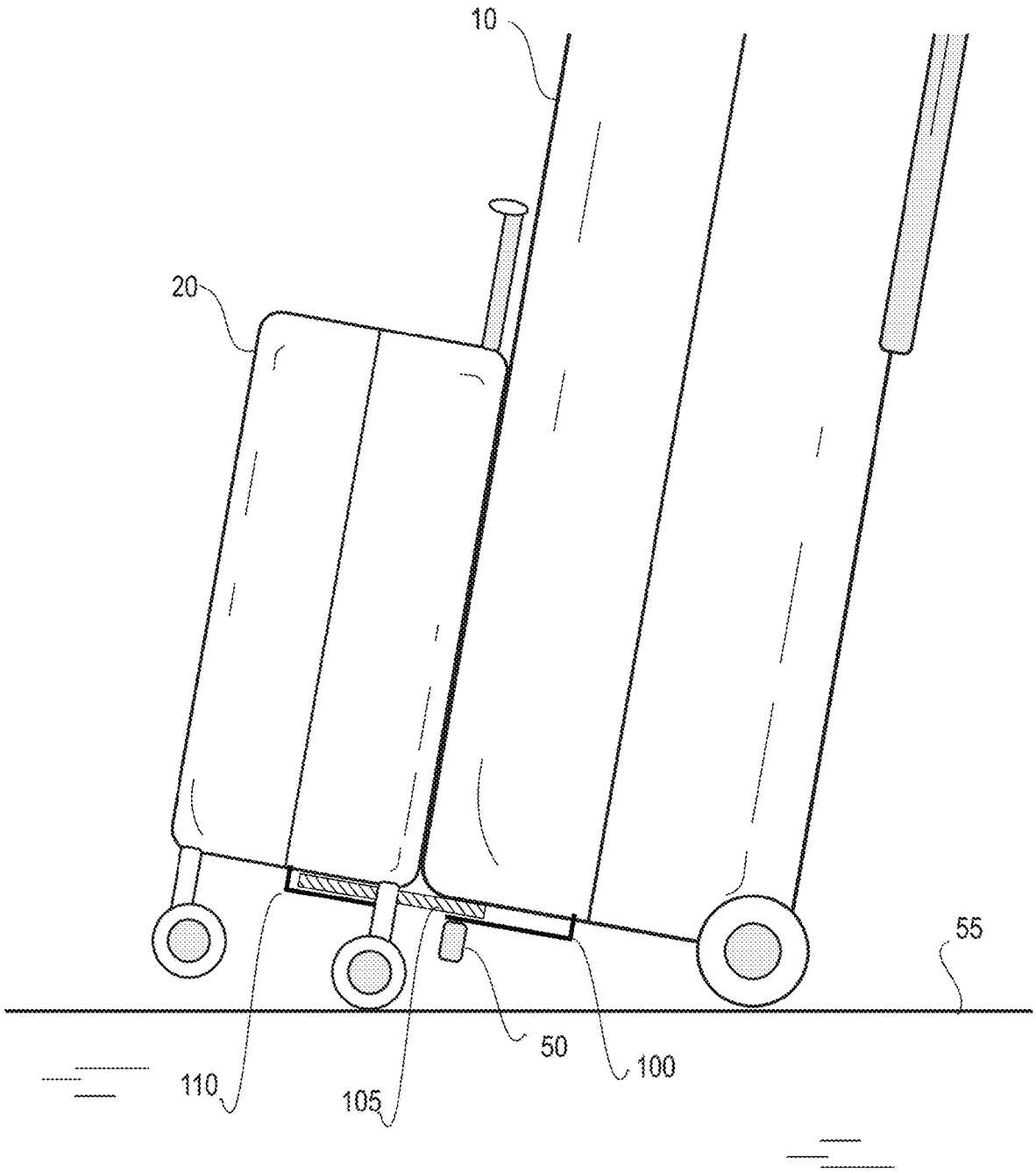
FIG. 5 is illustrative of, in side-on and partially cutaway view, an alternative male/female mutual engagement means.

Other mutual engagement and disengagement means may be incorporated in the present invention, with one alternative being shown in FIG. 5. This embodiment is reliant on the rigid mechanical connection being made at the bases of the large 10 and small 20 luggage items. The large luggage item 10 comprises a shallow but broad tunnel 100 and a rigid plate 105 which is slidable into the tunnel (so as to be concealed, as would be the case where the large luggage item is used separately), and slidable out of the tunnel (as drawn, so as to extend outwardly from the luggage item 10 as would be the case for mounting the small luggage item 20 thereon). The small luggage item 20 comprises a tunnel 110 of the same dimensions as for 100, and is configured to receive the rigid plate 105 (as drawn). The rigidity of the luggage item 10, 20 bases and the tunnels 100, 110 and the plate 105 results in the tilt angle of both luggage items 10 and 20 being maintained. To prevent any movement of the rigid plate 105 within the tunnels 100 and 110 when the small luggage item 20 is mounted on the large luggage item 10, a user-operable spring loaded pin may extend from underneath and into tunnel 100 or 110 to engage with rigid plate 105 in a manner similar to that discussed supra with reference to the mutual engagement and disengagement means shown FIGS. 3A, 3B, 4A and 4B.

Figure 7:
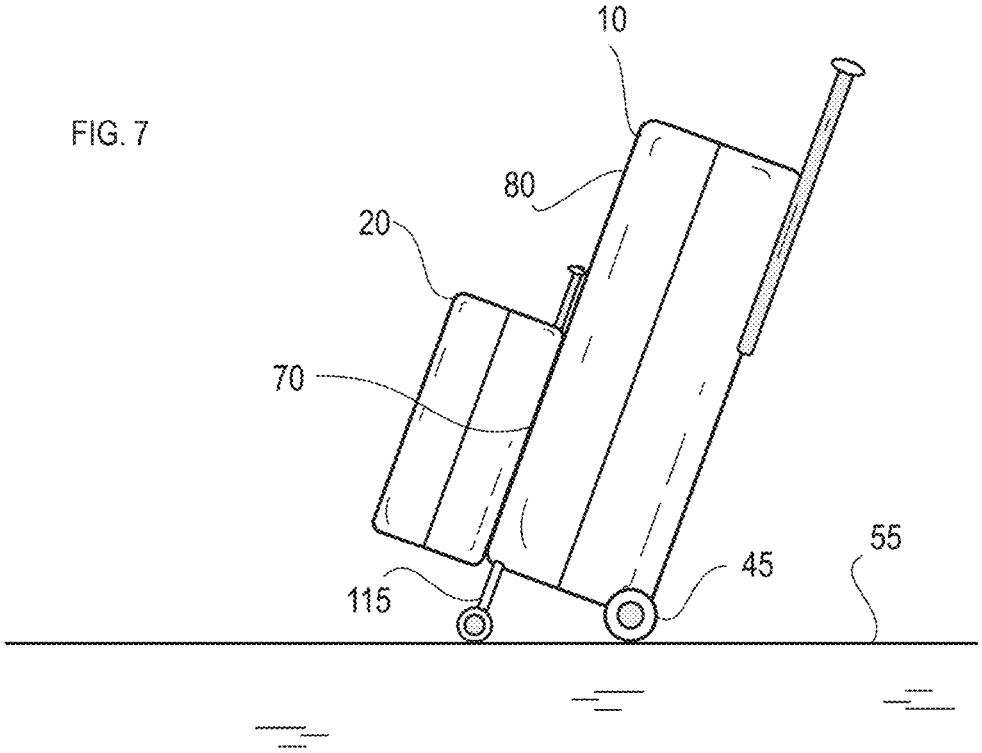
FIG. 7 is illustrative of, in side-on view, two connected luggage items, with only one of the two luggage items having rolling means. The luggage item having rolling means is capable of maintaining tilt angle on its own, and by virtue of an extendible/retractable castor.

A further embodiment of the invention is shown at FIG. 7. As for the embodiments outlined supra, the system of connected luggage shown at FIG. 7 relies on a first item of luggage having a tilt angle maintained. However, in this embodiment the tilt angle of the large luggage item 10 is maintained by way of an extendable castor 115, which is lockable in the extended position (as drawn). In a less preferred embodiment, the castor 115 is fixed in the extended position as drawn.

By virtue of the tilt angle of the large luggage item 10, a small luggage item 20 can be mounted thereon. It will be appreciated that in this embodiment the small luggage item 20 has no role in maintaining the tilt angle of the large luggage item 20, and accordingly there is no requirement for any substantially rigid mutual engagement means, or any rigidity in the portions of the luggage items 10, 20 to which any engagement means are fixed or integral with. Indeed, the smaller luggage item 20 may have a strong loop of fabric (not shown) on the face 70 allowing hanging from a hook (not shown) extending from the face 80 of the large luggage item.

The tilt angle of the large luggage item, translates generally to the small luggage item 20 thereby shifting the centre of gravity of the connected arrangement to the right (as drawn), and preferably between castor 115 and the wheel 45. This results in a more stable arrangement that is less likely to tip forward (to the left, as drawn) due to the weight of the second luggage item 20.

The castor 115 can be retracted into the body of the large luggage item 10, such that the large luggage item 10 is brought to a substantially vertical position as would be typically required when used on its own.

Figure 8:
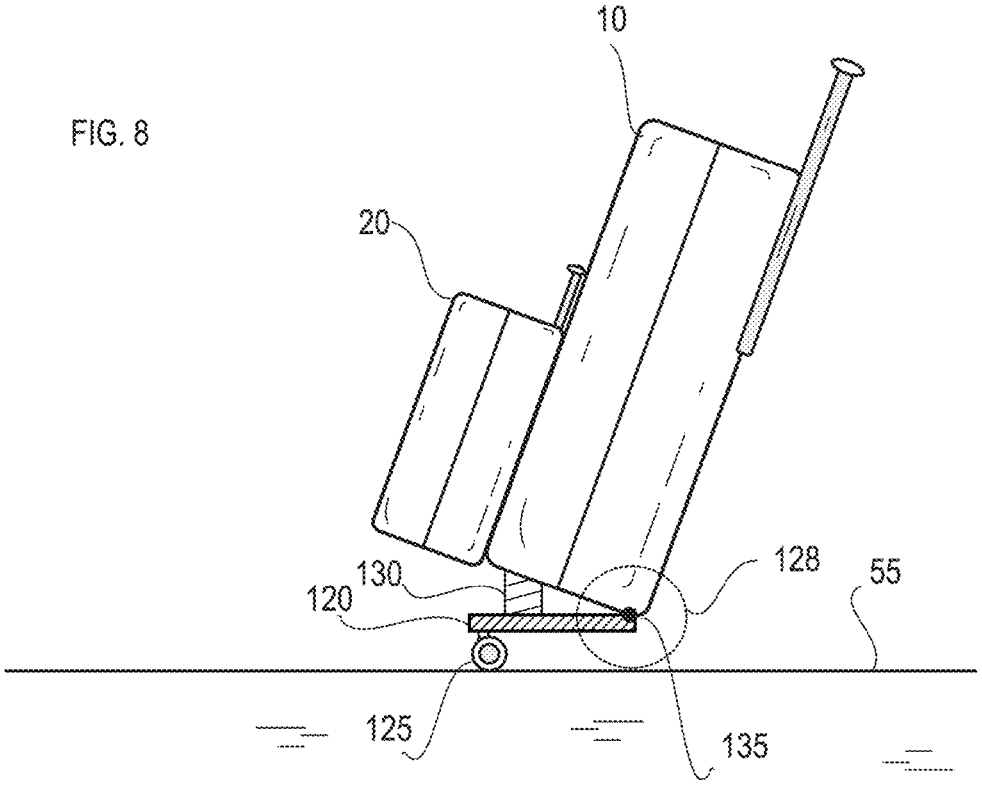
FIG. 8 is illustrative of, in side-on view, two connected luggage items, with only one of the two luggage items having rolling means. The luggage item having rolling means is capable of maintaining tilt angle on its own, and by virtue of a hinged platform.

FIG. 8 shows yet a further alternative whereby the tilt angle of the large luggage item 10 is provided by a support platform 120 having paired castors 125 at one end and paired wheels 128 (drawn ghosted) at the other. The platform 120 is connected to the container part of the luggage item proper by way of a hinge 135. A helical spring 130 acts to maintain the tilt angle. The tilt angle can be removed and the luggage item 10 returned to a vertical position by the user urging the small luggage item 20 downwardly so as to compress the helical spring 130. A catch (not shown) engages to maintain the large luggage item 10 in a vertical orientation. At that time, the small luggage item 20 may be dismounted with both large 10 and small 20 luggage items being usable independently.

As for the embodiment of FIG. 6, the second luggage item 20 is mounted on the first luggage item 10 by any suitable means. The centre of gravity of the connected arrangement is also shifted to the right (as drawn) of the castor 125 so as to improve stability. Moreover, the embodiments of FIGS. 7 and 8 each have only four rolling means in contact with the substrate thereby improving manoeuvrability over the situation where both large 20 and small 10 luggage items have rolling means.

In constructing and testing embodiments of the invention as described supra, it has been found that while the invention was entirely operable a problem presented. In particular, it was noted that the manoeuvrability of the connected first and second luggage items was not as smooth as desired.

Taking for example the embodiment of FIG. 2, it will be noted that the connected arrangement rolls on the paired rear wheels 45 of the first luggage item 10 and the paired rear castors 160 of the second luggage item 20. It has been found that manoeuvrability is improved where the swivel angle of each of the rear pair of castors 160 are tilted such that the swivel axes are adjusted so as to be perpendicular, or closer to perpendicular to the underlying ground.

Figure 9A:
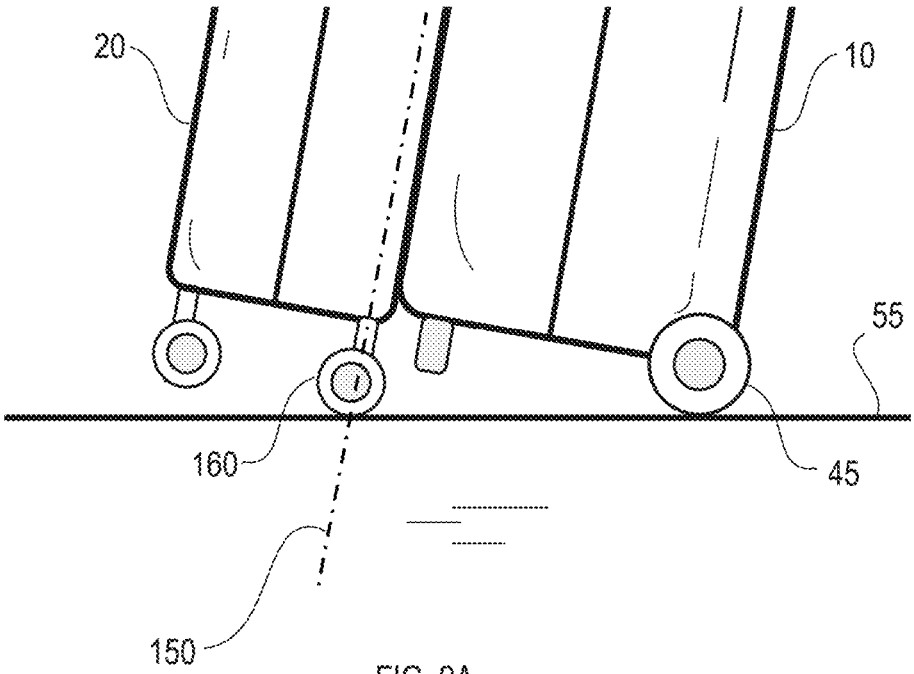
FIG. 9A is illustrative of, in side-on view, the non-perpendicular swivel axis of a rear castor, compared with FIG. 9B showing the perpendicular swivel axis of a rear castor.
Figure 9B:
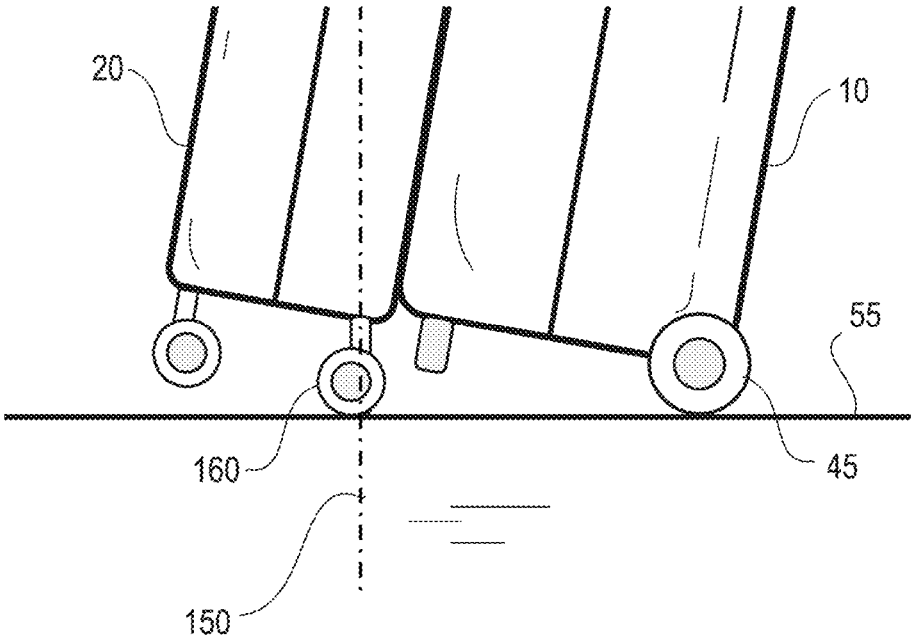

As will be noted from FIG. 9A the swivel axes 150 of the rear castors 160 are angled to the ground 55, this being the situation shown in FIG. 2. It has been found that the angle formed by swivel axes inhibits the ability of the rear castors 160 on the second luggage item 20 to properly swivel. This reduced ability to properly swivel accounts for the difficulties in manoeuvrability noted for the embodiment of FIG. 2. This difficulty is overcome or ameliorated where the rear castors 160 are configured to be adjustable to a second position, as shown in FIG. 9B whereby the swivel axis 150 is substantially perpendicular to the ground 55. While a substantially perpendicular swivel axis is preferred, angles less than perpendicular (such as about 89, 88, 87, 86, or 85 degrees) may nevertheless provide an improvement over the situation where no adjustment in the angle of the swivel axis is made.

Preferably, the second luggage item 20 is configured such that the swivel axis 150 of each rear castor 160 is lockable in the adjusted position as shown in FIG. 9B such that a user may allow the connected luggage 10, 20 to stand without the swivel angle 150 of the rear castors 160 of the second luggage item 20 returning to their original angle. The second luggage item 20 should also be configured such that the swivel axis 150 of each rear castor 160 is releasable from the locked state in the adjusted position as shown in FIG. 9B, and returnable to the original position shown in FIG. 9A.

In one embodiment, the second luggage item 20 comprises a mechanism configured to alternately tilt and until the swivel axis of each rear castor of the second luggage item 20. Preferably, the mechanism is operable automatically, and may react to an altered angle of the second luggage item (relative to the ground) or react to the second item 20 of luggage being connected to the first item of luggage 10.

Particular advantage is provided where the mechanism is configured to tilt the swivel axes of the rear castors at an angle equivalent to that which the second item of luggage 20 it tilted as a result of user connecting the first item of luggage 10 to the second item of luggage 20.

Figure 10:
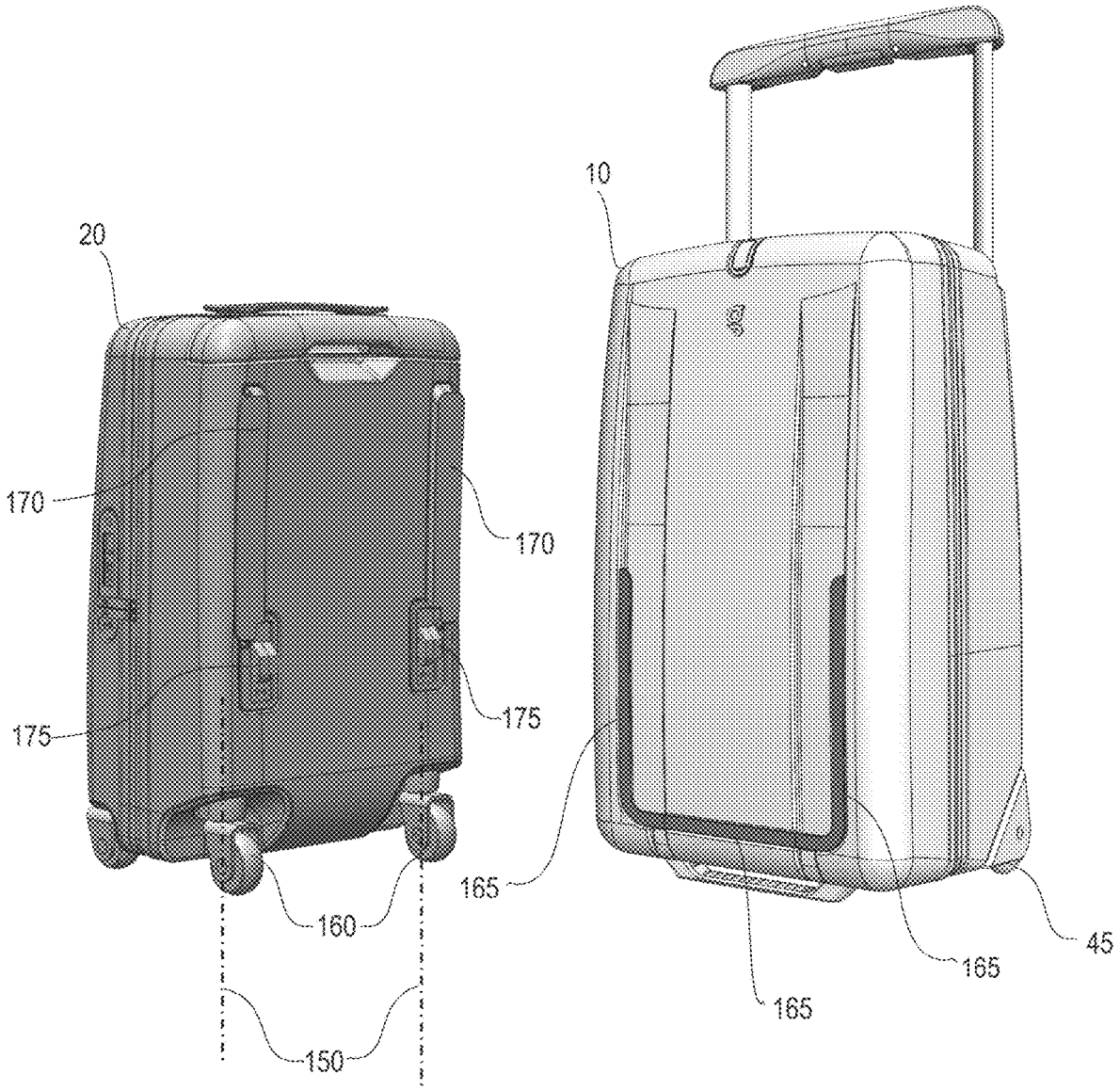
FIG. 10 is illustrative of, in perspective view, two luggage items of a system of the present invention when separate, and showing on their opposing faces means for mechanically connecting the two items and also the outwardly visible components of a wheel tilting mechanism.

Reference is made now to FIG. 10 and onwards showing (i) a luggage system having an alternative engagement and disengagement means to that shown in FIGS. 3A, 3B, 4A and 4B, and (ii) a luggage system having a wheel tilt mechanism configured to adjust the angle of the swivel axes of the rear castors of the second luggage item.

FIG. 10 shows the alternative engagement and disengagement means. On the first luggage item 10 there is provided a substantially vertically-oriented U-shaped receiving channel 165. On the second luggage item 20 there is provided paired channel engagement portions 170 configured to be received by the vertical portions of the U-shaped receiving channel 165. Just inferior to the paired channel engagement portions 170, are the external parts 175 of paired rear wheel tilting mechanisms. The external parts 175 function to actuate a mechanism which tilts the swivel axes 150 of the paired castors 160, as will be more fully described infra.

Figure 11:
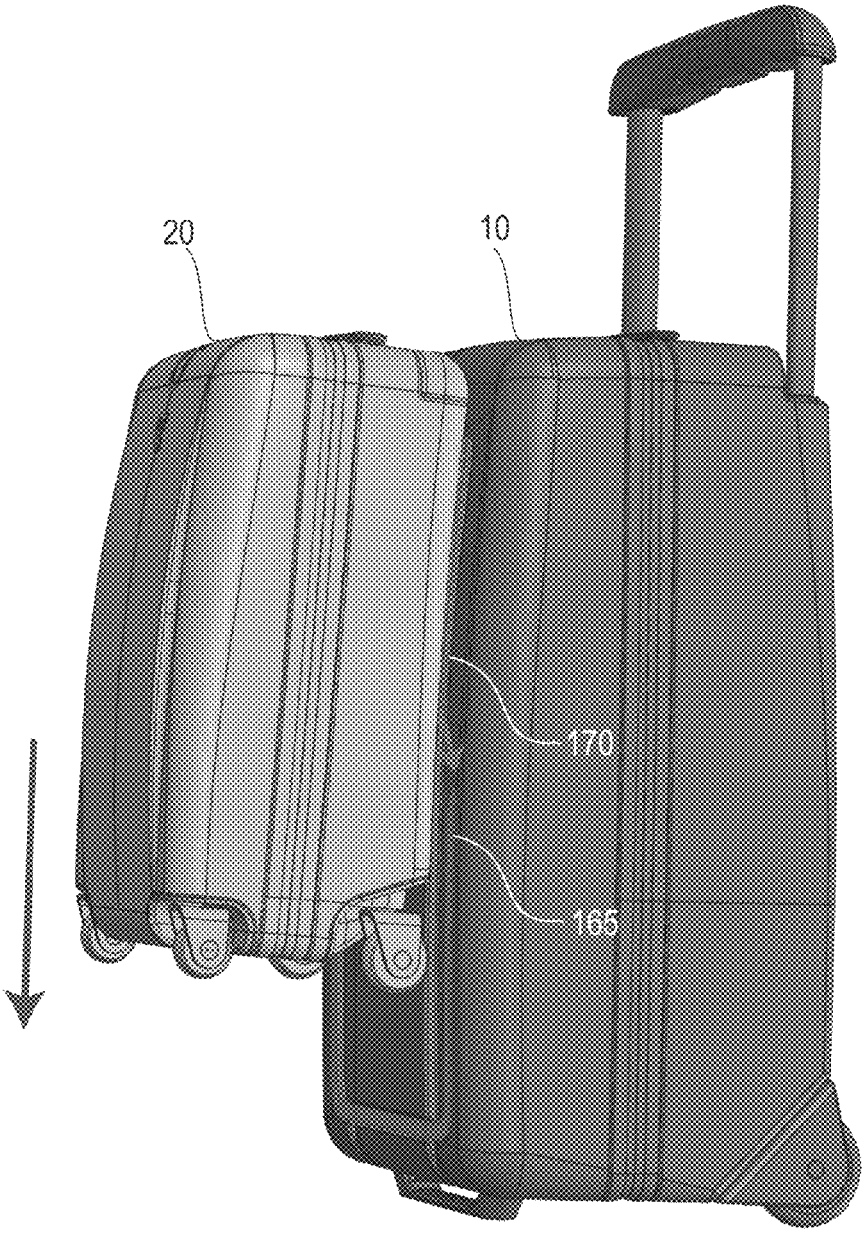
FIG. 11 is illustrative of, in perspective view the two luggage items shown in FIG. 10 in the process of being connected. The downward arrow indicate the direction of movement of the left-hand luggage item relative to the right hand luggage item.

To connect the two items of luggage, the first luggage item 10 is rested steady on the ground while the second luggage item 20 is elevated by the user such that the paired channel engagement portions 170 are disposed above the vertical arms of the U-shaped channel 165 as shown in FIG. 11. The second luggage item 20 is lowered by the user such that the lower ends of the paired channel engagement portions 170 slidingly engage with the upper ends of the vertical arms of the U-shaped channel 165. Once engaged, the second luggage item is allowed to travel downwardly by gravity.

Figure 12:
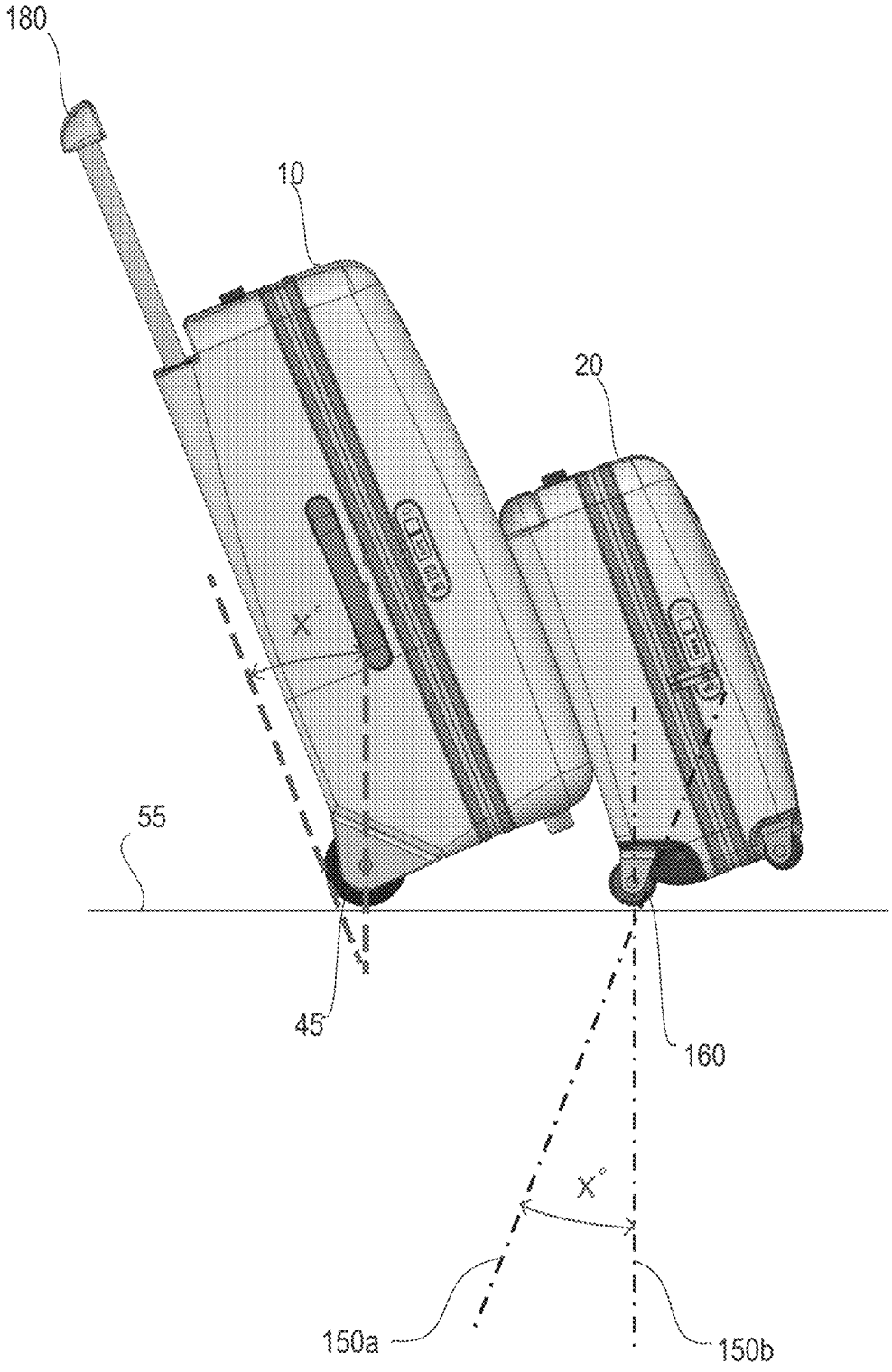
FIG. 12 is illustrative of, in perspective view the two luggage items shown in FIG. 10 after having been connected, and in a state ready to be rolled and manoeuvred about.

In the course of downward travel, the external parts 175 of the rear wheel tilting mechanisms are actuated by the horizontal portion of the U-shaped channel 165 so as to cause the swivel axes 150 of the castors 160 to tilt at an angle of X degrees, from the axis 150*a* to the axis 150*b* as shown in FIG. 12. The angle X is the same angle formed by the longitudinal axis of the first luggage item 10 when tilted. In the state shown in FIG. 12, the connected luggage items 10 and 20 are ready to be rolled and manoeuvred by a user holding the extended handle 180 of the first luggage item 10. The connected luggage items 10 and 20 roll on the paired wheels 45 (which are non-swivelling) and also the swivelling castors 160. Importantly in this embodiment, the swivel axes 150 of the castors 150 have been tilted by a tilting mechanism such that the swivel axes are perpendicular to the ground 55 as indicated 150*b*. The first luggage item 10 and second luggage item 20 are reversibly locked in the relative spatial arrangement shown in FIG. 12 such that the angle X degrees are maintained.

Figure 13:
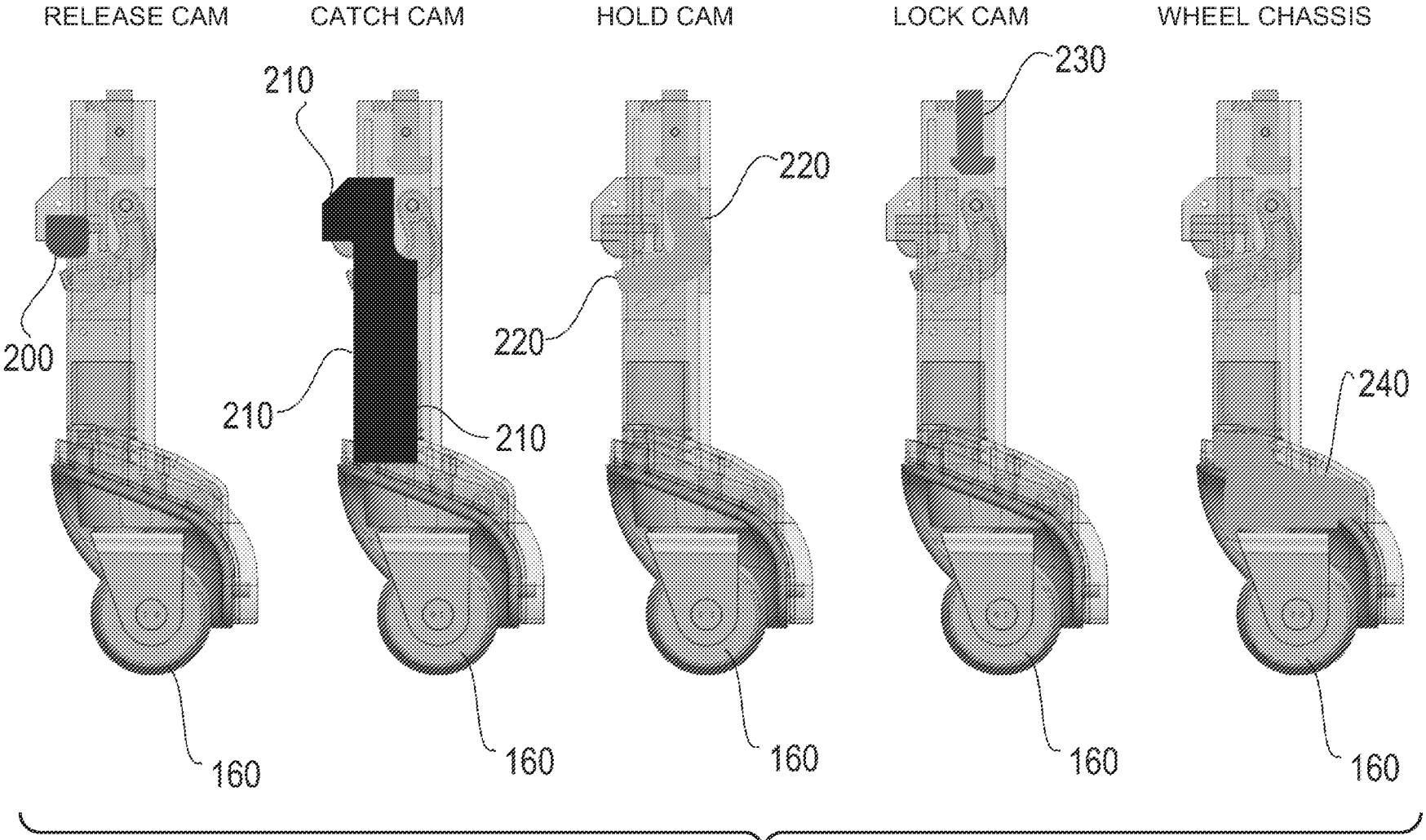
FIG. 13 is illustrative of, in lateral transparent view, a combined rear castor and wheel tilting mechanism. Each drawing highlights the position of a given component. Each drawing shows the combination in a neutral state with no external forces acting on any components and the swivel axis in an untilted state.

Turning now to the real wheel tilting mechanism, reference is made to FIG. 13 showing the following moving parts thereof: release cam 200, catch cam 210, hold cam 220, lock cam 230 and wheel chassis 240.

Figure 14A:
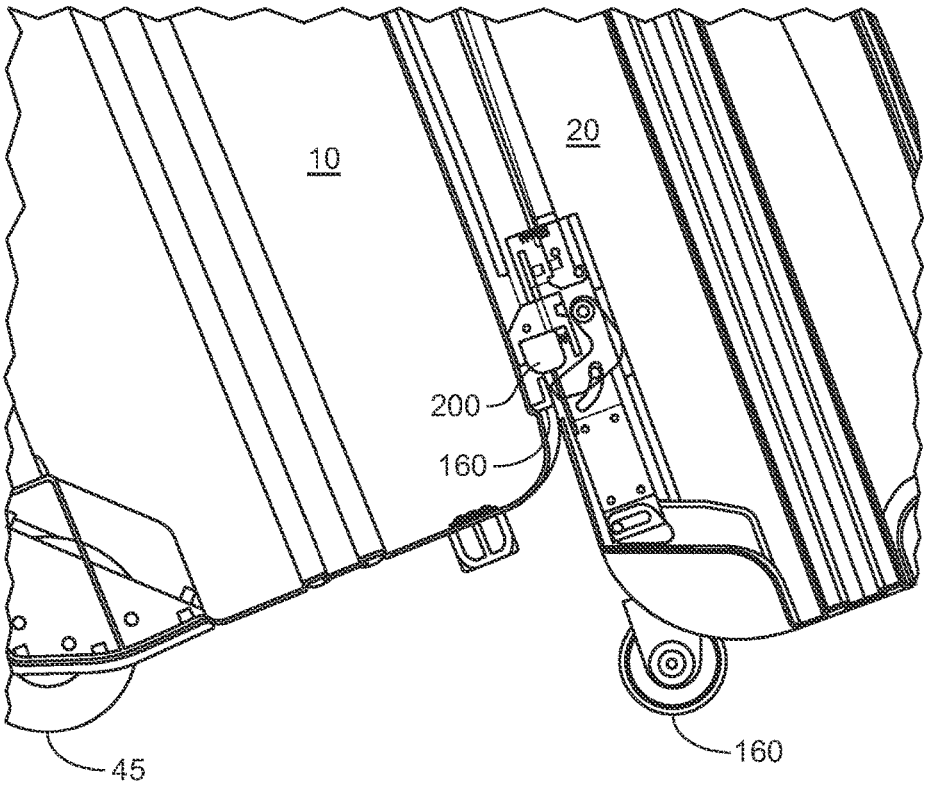
FIG. 14 is illustrative of, in lateral transparent view, the first steps in connecting two luggage items with regard to actuation of a wheel tilting mechanism.
Figure 14B:
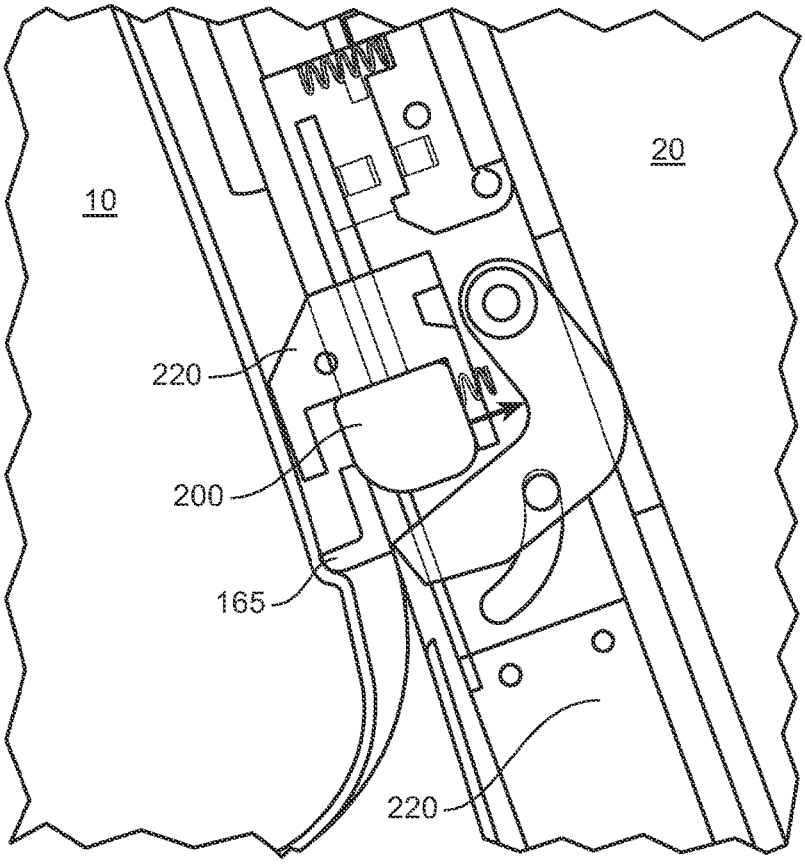

FIG. 14 shows the first step in actuation of the tilting mechanism. As the second luggage item 20 is lowered, the horizontal portion of the U-shaped channel 165 of the first luggage item 10 depresses the release cam 200 of the tilting mechanism, urging the release cam 200 generally laterally toward the interior of the second luggage item 20. This lateral movement allows the catch cam 210 to slide vertically.

Figure 15A:
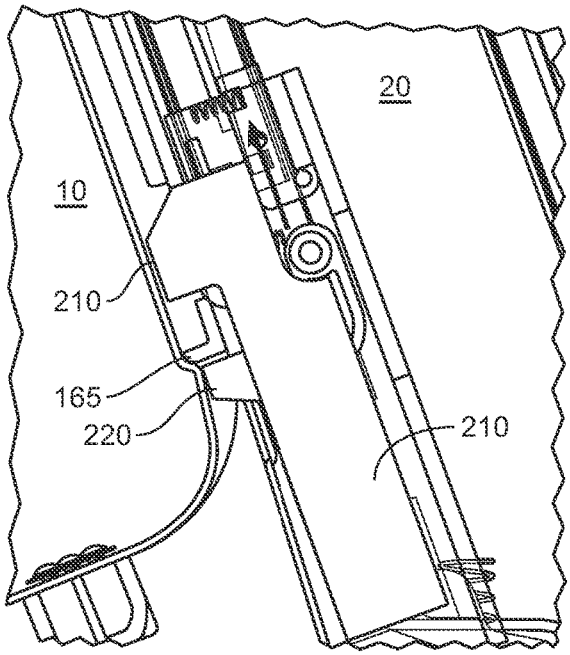
FIG. 15 is illustrative of, in lateral transparent view, further steps in connecting two luggage items with regard to actuation of a wheel tilting mechanism.
Figure 15B:
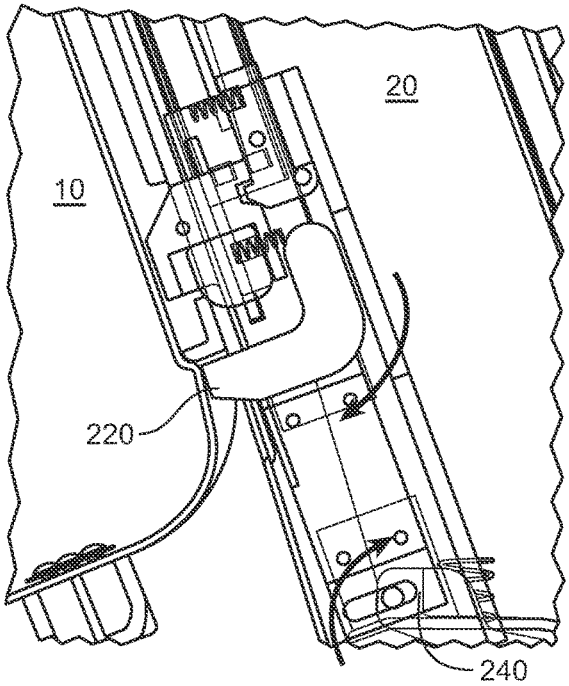
Figure 15C:
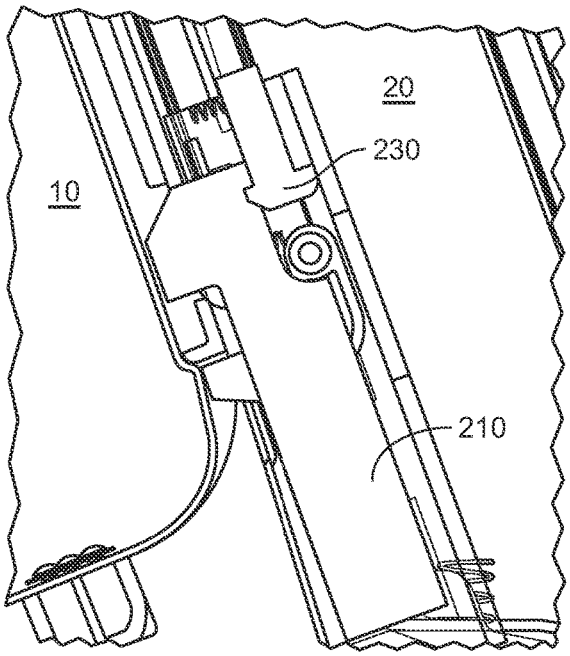

Reference is now made to FIG. 15 to further describe the operation of the wheel tilting mechanism. At this point it should be noted that the in the sequential steps shown as FIGS. 15A, 15B and 15C the mechanism parts are shown stationary, which is not reflective of their actual positions in the sequence.

As the second luggage item 20 continues in its downward travel, the horizontal portion of the U-shaped rail 165 pushes the catch cam 210 upwardly vertically (as shown in FIG. 15A; the upward vertical movement being relative to the mechanism as a whole, and also to the second luggage item generally) so as to simultaneously rotate the wheel chassis 240 and hold cam 220 clockwise as shown in FIG. 15B. Rotation of the wheel chassis 240 effects the required tilting of the swivel axis of the castor comprising the wheel chassis.

The catch cam 210 and hold cam 220 cooperate so as to hold the first luggage item 10 in fixed spatial relation to the second luggage item 20. This is achieved by the horizontal portion of the U-shaped channel 165 being entrapped between the leftward-extending head portion of the catch cam 210 and the leftward extending portion of the hold cam 220. By this entrapment, the first 10 and second 20 items of luggage are thereby prevented from sliding relative to each other.

As the catch cam 210 approaches the top of its vertical travel it engages with the lock cam 230 by way of a leftward-opening recess in the catch cam 210 receiving a rightward-extending protrusion of the lock cam 230 (see FIG. 15C). As this point, the wheel chassis 240 is at maximum tilt angle, and therefore the swivel axis of the rear castor is also at its maximum tilt angle.

Figure 16:
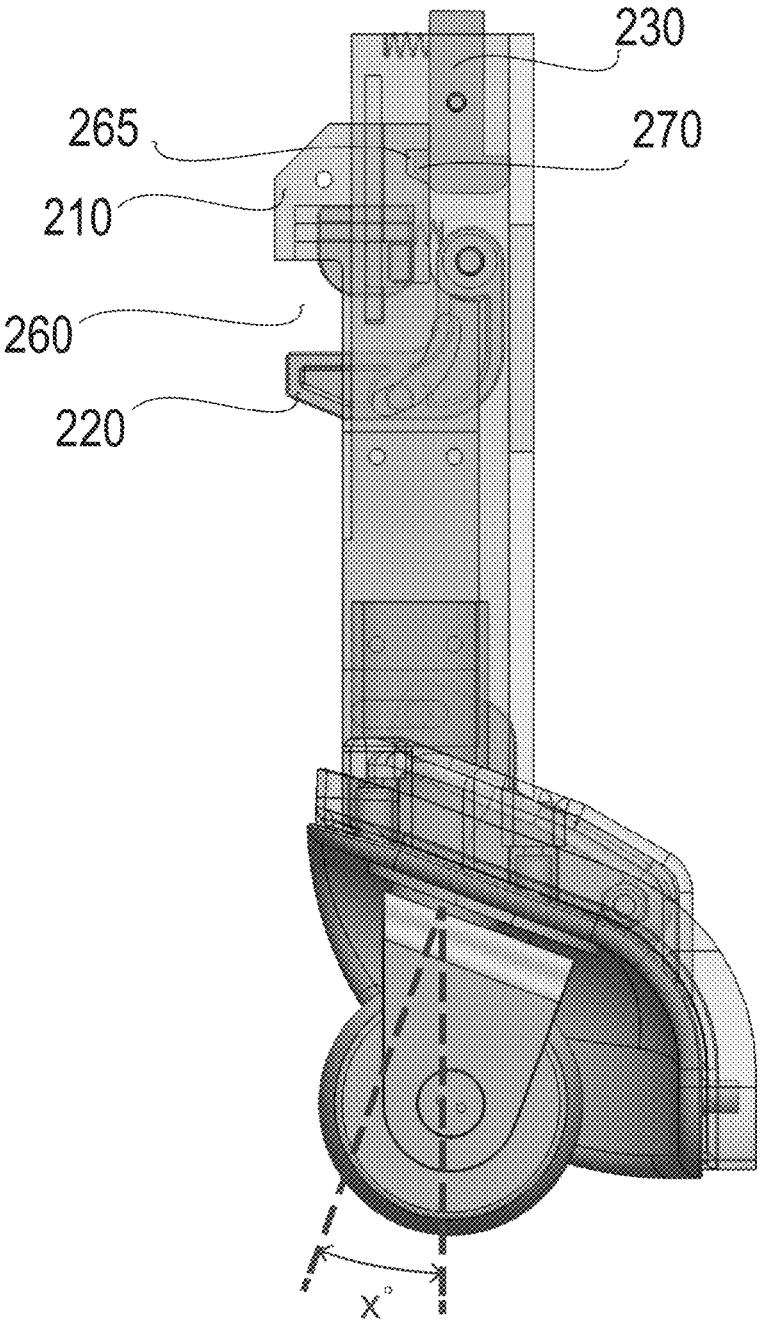
FIG. 16 is illustrative of, in lateral transparent view, a wheel tilting mechanism whereby the swivel angle of the caster is maximally tilted.

Engagement between the lock cam 230 and catch cam 210 locks the castor at maximum tilt angle. That situation being shown at FIG. 16. The space in which the horizontal portion of the U-shaped channel 165 is entrapped is shown marked 260. Furthermore, shown as 265 is the recess of the catch cam 210 which engages the head portion 270 of the lock cam 230.

At some point in time, the user will wish to disconnect the first 10 and second 20 luggage items. As will be appreciated, this requires disengagement of the lock cam 230 from the catch cam 210. In this preferred embodiment, this disengagement is effected by a cable acting on the lock cam 230. The cable in turn is pulled by the user lifting the handle of the second luggage item 20.

Figure 17:
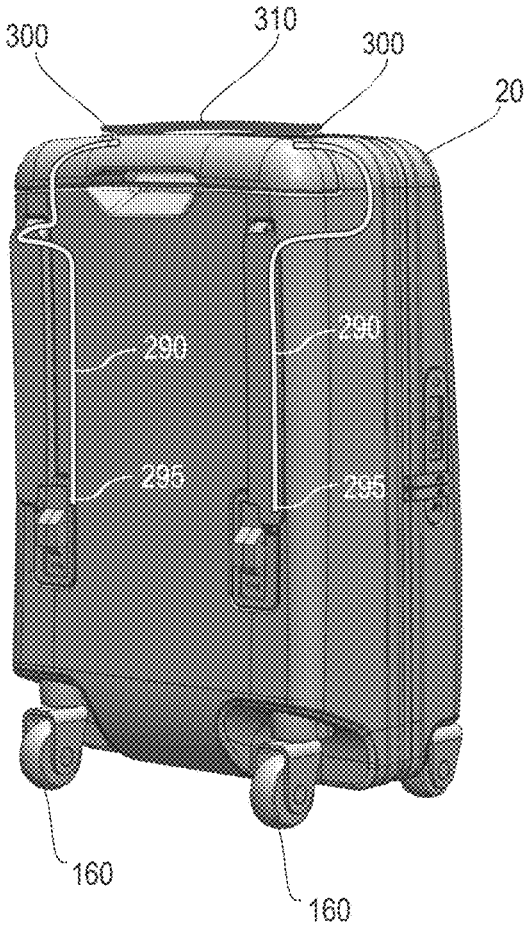
FIG. 17 is illustrative of, in perspective view, a luggage item having a pair or rear castors showing the position of cables which actuate the tilting mechanisms of the rear castors.

Reference is made to FIG. 17 showing the path of travel of paired Bowden cables 290, each running from a wheel tilting mechanism at point 295 to a point 300 proximal the handle 310.

Figure 18:
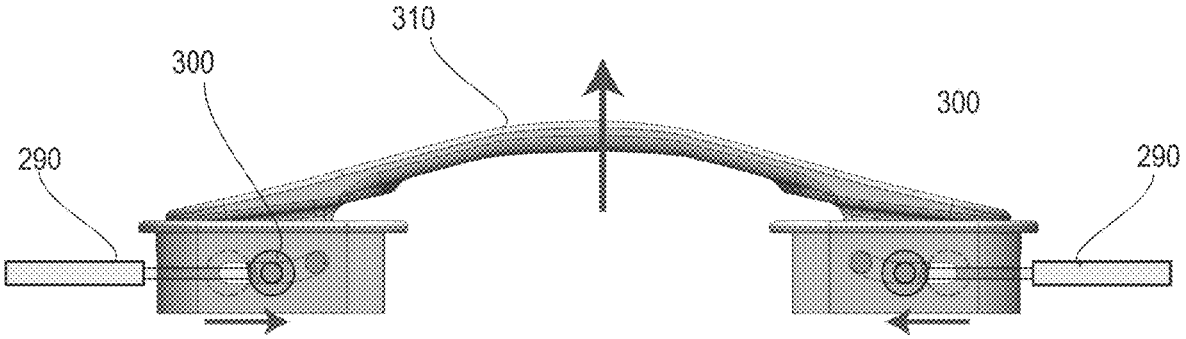
FIG. 18 is illustrative of, in lateral transparent view, the carrying handle of the luggage item shown in FIG. 17 showing the means for connecting the cables to the carry handle.

FIG. 18 shows the connection of the Bowden cables at points 300 to the carry handle 310 of the second luggage item 20. As the user lifts the handle 310 vertical (purposefully, so as to intentionally disengage the first 10 and second 20 baggage items), the vertical force is translated into horizontal force so as to pull the wires of the Bowden cables 290.

Figure 19A:
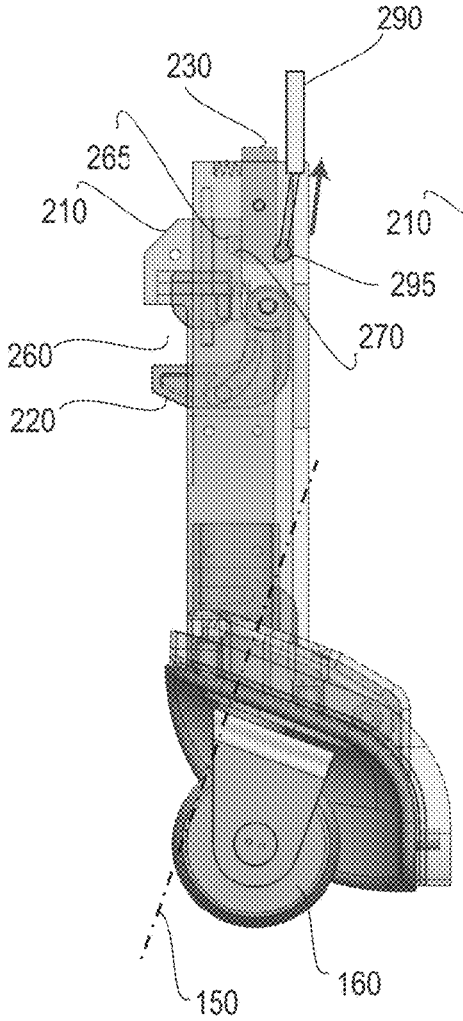
FIG. 19A shows the mechanism as the cable is initially pulled.
Figure 19B:
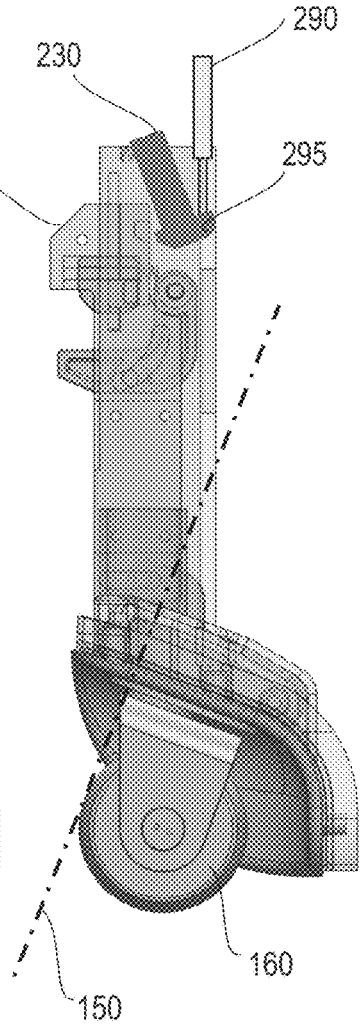
FIG. 19B shows the mechanism when the cable is fully pulled so as to unlock the wheel tilting mechanism.

FIG. 19 shows the result of the Bowden cables being pulled on the wheel tilting mechanism. As will be seen, the wires of the Bowden cables 295 attach at points 295 to the lock cam 230. When the Bowden cable wires are pulled upwardly (as occurs when the user pulls upwardly on the carry handle of the second luggage item), the lower end of the lock cam pivots to the right (as shown in FIG. 19B) so as to disengage from the recess 265 of the catch cam 210. This allows the second luggage item 20 to be pulled upwardly relative to the first luggage item, and released from the U-shaped channel 165 of the first luggage item 10. Specially, the rightward-extending portion of the hold cam 220 is allowed to rotate away from underneath the horizontal portion of the U-shaped channel 65 (which was previously entrapped), thereby permitted upward movement of the second luggage item 20.

Figure 19C:
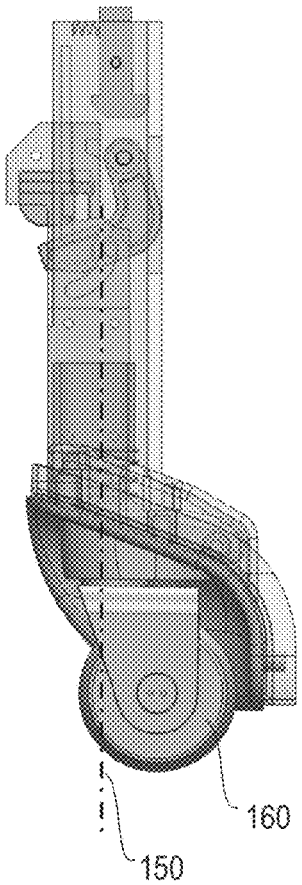
FIG. 19C shows the swivel axis of the castor wheel when returned to the untilted state and in a neutral position.

Once the second luggage item is pulled upwardly, the rear castors can return to the neutral position, as shown in FIG. 19C where the rear castor is untitled. The mechanism locks in this state when no forces are present, and by the action of the various springs shown in the drawings When the rear castors 160 are in the neutral position, the second luggage item may be placed on the ground with the swivel axes of both the front castors and rear castors 160 being substantially perpendicular to the ground. In this state, the second luggage item is operable as for a prior art "spinner case". With the second luggage item 20 removed, the first luggage item 10 is operable as for a prior art rolling case.

The present invention allows for the simple connection and separation of luggage items as required. For example, the items may be separated whilst in a vehicle en route to the airport (so as to fit within the vehicle trunk) and then connected when walking through the airport to a check-in counter (at which time the connected arrangement functions as an easily manoeuvrable baggage trolley), and then disconnected when checking in such that one items is sent to the aircraft baggage hold and the other is kept with the traveller as carry-on luggage. The separated carry-on luggage maintains the ability to be wheeled around the airport as the traveller proceeds to the boarding lounge.

It will be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. Components may be added or deleted from drawings and method steps may be interchanged amongst methods. Steps may be added or deleted to methods described within the scope of the present invention.

Although the invention has been described with reference to specific examples, it will be appreciated by those skilled in the art that the invention may be embodied in many other forms.

The invention claimed is:

1. A system of interconnecting luggage, the system comprising:

a first luggage item having a handle about an upper end and rolling means about a base, and being tiltable about a rotational axis of the rolling means by the handle, a second luggage item having rolling means about a base, each of the first and second luggage items having integral mutual engagement and disengagement means configured to provide, when the first and second luggage items are mutually engaged, a substantially rigid mechanical connection that maintains the first and second luggage items in a fixed mutual spatial arrangement such that when the system is in a stable arrangement the rolling means of the first and second luggage items contact an underlying planar substrate, and the first luggage item is maintained at a tilt angle relative to the underlying planar substrate.

2. The system of claim 1, wherein the first luggage item has a long axis, and the long axis of the first luggage item is tilted when the system is in a stable arrangement whereby the rolling means of the first and second luggage item contact an underlying planar substrate, the tilt being in a direction such that the long axis of the first luggage item forms an acute angle with the underlying planar substrate.

3. The system of claim 1, wherein the tilt angle of the first luggage item is maintained by way of the mutual engagement and disengagement means in combination with the support of the second luggage item.

4. The system of claim 1, wherein when the first and second luggage items are mutually engaged and the system is in a stable arrangement whereby the rolling means of the first and second luggage item contact an underlying planar substrate, the tilt angle of the first luggage item is greater than about 0.1 degrees, or is greater than about 0.5 degrees, or is greater than about 1 degrees, or is greater than about 2 degrees, or is greater than about 3 degrees, or is greater than about 4 degrees, is greater than about 5 degrees, or is greater than about 6 degrees, or is greater than about 7 degrees, or is greater than about 8 degrees, or is greater than about 9 degrees, or is greater than about 10 degrees, or is greater than about 10 degrees, or is greater than about 11 degrees, or is greater than about 12 degrees, or is greater than about 13 degrees, or is greater than about 14 degrees, or is greater than about 15 degrees, the tilt angle being taken with reference to (i) a line orthogonal to a planar substrate on which the system is disposed, or (ii) the vertical.

5. The system of claim 1, wherein the second luggage item has rolling means proximal to the first luggage item and rolling means distal to the first luggage item such that when the first and second luggage items are mutually engaged and the system is in a stable arrangement the rolling means of the first and second luggage item contact an underlying planar substrate, and the rolling means of the second luggage item that is proximal to the first luggage item contacts the underlying planar substrate, and the rolling means of the second luggage item that is distal to the first luggage item does not contact the underlying substrate.

6. The system of claim 1, wherein one, some or all of the rolling means of the second luggage item has a swivel axis.

7. The system of claim 6, wherein an angle of the swivel axis is adjustable, and wherein the second luggage item is configured such that the swivel axis is adjusted or adjustable when the substantially rigid mechanical connection is formed between the first and second luggage items by way of the integral mutual engagement and disengagement means.

8. The system of claim 6, wherein the rolling means of the second luggage item having a swivel axis is proximal to the first luggage item.

9. The system of claim 6, wherein an angle of the swivel axis is adjustable, and wherein the second luggage item and/or the rolling means of the second luggage item is/are configured such that that the angle of the swivel axis relative to an axis of the second luggage item and/or relative to an axis of the first luggage item is adjusted or adjustable.

10. The system of claim 9, wherein the second luggage item and/or the rolling means of the second luggage item is/are configured such that that the angle of the swivel axis relative to an axis of the second luggage item and/or relative to an axis of the first luggage item is alternatively lockable to lock the angle of the swivel axis, and unlockable to allow adjustment of the angle of the swivel axis.

11. The system of claim 9, wherein the angle of the swivel axis is adjustable such that when the first luggage item is tilted at an angle, the second luggage item is tilted at the same angle, the swivel axis is substantially vertical.

12. The system of claim 1, wherein when the first and second luggage items are mutually engaged and the system is in a stable arrangement whereby the rolling means of the first and second luggage item contact an underlying planar substrate, only a single rolling means of the first luggage item contacts the underlying planar substrate, and only a single rolling means of the second luggage item contacts the underlying planar substrate.

13. A first luggage item comprising:

a handle about an upper end;

rolling means about a base, and being tiltable about a rotational axis of the rolling means by the handle; and integral mutual engagement and disengagement means configured to provide, when the first luggage item is mutually engaged with a second luggage item having a corresponding mutual engagement and disengagement means, a substantially rigid mechanical connection that maintains the first and second luggage items in a fixed mutual spatial arrangement such that the rolling means of the first luggage item contacts an underlying planar substrate, and the first luggage item is maintained at a tilt angle relative to the underlying planar substrate.

14. The first luggage item of claim 13, wherein the rolling means has a swivel axis, and the swivel axis is adjustable, and wherein the first luggage item and/or the rolling means having a swivel axis is/are configured such that such that an angle of the swivel axis relative to an axis of the first luggage item is adjusted or adjustable.

15. The first luggage item of claim 14, wherein the first luggage item and/or the rolling means is/are configured such that that the angle of the swivel axis relative to an axis of the first luggage item is alternatively lockable to lock the angle of the swivel axis, and unlockable to allow adjustment of the angle of the swivel axis.

16. The first luggage item of claim 14, wherein the angle of the swivel axis is adjustable such that when the first luggage item is tilted at an angle, the angle swivel axis is substantially vertical.

17. The first luggage item of claim 14, wherein the engagement and disengagement means is configured to provide a substantially rigid mechanical connection with the second luggage item, wherein the first luggage item is configured such that the angle of the swivel axis is adjusted or adjustable when the substantially rigid mechanical connection is formed between the first luggage item and the second luggage item.

* * * * *